US005627570A

United States Patent [19]

Hiramatsu et al.

[11] Patent Number: 5,627,570

[45] Date of Patent: May 6, 1997

[54] INK JET RECORDING METHOD USING MOVABLE DETECTION FLAGS

[75] Inventors: Soichi Hiramatsu; Kenichirou Hashimoto; Hideo Fukazawa, all of Yokohama, Japan

[73] Assignee: Canon Kabushiki Kaisha, Tokyo, Japan

[21] Appl. No.: 247,118

[22] Filed: May 20, 1994

Related U.S. Application Data

[60] Continuation of Ser. No. 928,357, Aug. 12, 1992, abandoned, which is a division of Ser. No. 513,932, Apr. 24, 1990, Pat. No. 5,168,291.

[30] Foreign Application Priority Data

| | | | |
|---|---|---|---|
| Apr. 24, 1989 | [JP] | Japan | 1-101662 |
| Jun. 2, 1989 | [JP] | Japan | 1-139307 |
| Apr. 19, 1990 | [JP] | Japan | 2-103755 |

[51] Int. Cl.[6] ..... B41J 2/175

[52] U.S. Cl. ..... 347/19; 347/37; 347/86

[58] Field of Search ..... 347/19, 86, 85, 347/37

[56] References Cited

U.S. PATENT DOCUMENTS

| | | | |
|---|---|---|---|
| 4,277,791 | 7/1981 | Rosenstock et al. | 347/86 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,475,825 | 10/1984 | Hashimoto . | |
| 4,544,931 | 10/1985 | Watanabe | 347/17 |
| 4,558,333 | 12/1985 | Sugitani et al. . | |
| 4,609,925 | 9/1986 | Nozu . | |
| 4,675,696 | 6/1987 | Suzuki | 347/19 |
| 4,709,247 | 11/1987 | Piatt et al. . | |
| 4,723,129 | 2/1988 | Endo et al. . | |
| 4,740,796 | 4/1988 | Endo et al. . | |
| 4,825,231 | 4/1989 | Nozaki . | |
| 4,872,026 | 10/1989 | Rasmussen et al. | 347/49 |
| 4,888,602 | 12/1989 | Watanabe | 347/86 X |
| 4,977,413 | 12/1990 | Yamanaka et al. | 347/7 |

FOREIGN PATENT DOCUMENTS

| | | | |
|---|---|---|---|
| 0375407 | 6/1990 | European Pat. Off. | B41J 2/165 |
| 0412459 | 2/1991 | European Pat. Off. | B41J 2/175 |
| 0423475 | 4/1991 | European Pat. Off. | B41J 2/165 |
| 2263467 | 7/1974 | Germany | B41J 21/12 |
| 2705282 | 8/1978 | Germany | B41J 29/50 |
| 33391138 | 5/1985 | Germany | B41J 27/00 |
| 3405164 | 8/1985 | Germany | B41J 27/00 |
| 3723954 | 4/1988 | Germany | B41J 3/04 |
| 54-56847 | 5/1979 | Japan | B41M 5/26 |
| 59-123670 | 7/1984 | Japan | B41J 3/04 |
| 59-138461 | 8/1984 | Japan | B41J 3/04 |
| 59-196282 | 11/1984 | Japan | B41J 21/12 |
| 60-71260 | 4/1985 | Japan | B41J 3/04 |
| 95224 | 5/1987 | Japan | B41J 3/04 |
| 62-255151 | 11/1987 | Japan | B41J 3/04 |
| 1133750 | 5/1989 | Japan | B41J 3/04 |

*Primary Examiner*—Joseph W. Hartary

*Attorney, Agent, or Firm*—Fitzpatrick, Cella, Harper & Scinto

[57] ABSTRACT

An ink jet recording method including the steps of providing a movable carriage having a sensor and which carries a recording head, as well as a plurality of flags in a movable range of the carriage. The method further includes the steps of determining a position of the carriage on a basis of an output of the sensor responsive to the flags, effecting a movement of the carriage through a predetermined distance on the basis of the output of the sensor, and effecting a predetermined operation on the basis of an output of the sensor.

6 Claims, 21 Drawing Sheets

INK JET RECORDING METHOD USING MOVABLE DETECTION FLAGS

This application is a continuation of application Ser. No. 07/928,357 filed Aug. 12, 1992, now abandoned, which is a divisional of application Ser. No. 07/513,932 filed Apr. 24, 1990, now U.S. Pat. No. 5,168,291.

FIELD OF THE INVENTION AND RELATED ART

The present invention relates to a serial type recording apparatus provided with a carriage for carrying a recording head which is preferably detachably mountable on the carriage, and an ink cassette therefor.

The present invention is particularly effective in a recording apparatus of an ink jet type having, in addition to a usual sheet feeding function, an automatic sheet feeding function, recovery function for sucking the ink in the recording head and the like.

Further, the present invention relates to an ink cassette functioning as an ink container detachably mountable to the recording apparatus.

A recording apparatus, particularly a serial type printer, requires a moving mechanism for the carriage carrying a recording head thereon, a sheet feeding device for feeding the recording material such as sheet and an automatic sheet feeding mechanism. In addition, when the recording apparatus is of an ink jet type, it may require head capping means for preventing failure of ink ejection attributable to the drying of the ink adjacent to the ink ejection outlets and a pumping means. In the conventional apparatus, these mechanisms and the devices are generally driven by separate driving means such as motors, solenoids and/or the like.

In a less expensive recording apparatus, one reversible motor is employed to effect plural operations.

However, the provision of the independent driving sources for the respective functions results in a costly apparatus and the requirement of space for the wiring therefor. It is possible to use a reversible motor together with a one-way clutch to function as driving sources for the sheet feeding and the automatic sheet feeding (ASF), but it results in the incapability of the reverse feeding of the recording sheet, thus degrading the performance of the apparatus, and in addition, the mechanism becomes extremely complicated with the increase of the multi-function mechanisms.

FIG. 16 is a perspective view of an ink jet printer as an exemplary recording apparatus of this kind.

FIG. 17 is a side view illustrating details of a part of the ink jet printer of FIG. 16.

The apparatus comprises a friction roller 5 for feeding a recording sheet 6 by friction to a recording position. The friction roller 5 is supported on a shaft 43 which is rotatably supported by left and right side plates (not shown) of the sheet feeding device. The recording sheet 6 is guided along the outer periphery of the friction roller 5 by a paper pan 38, and is press-contacted to the friction roller 5 by an unshown pinch roller. Thus, when the friction roller 5 is rotated, the recording sheet 6 is fed by the friction force to the platen 4 provided above the friction roller 5. The rotational movement of the friction roller 5 is effected by the rotational driving of a feed motor 21 through an intermediate gear 20 fixed on the shaft of the friction roller 43. The sheet confining plate 8 functions to guide the recording sheet 6 fed to the platen 4 so that it is urged toward the platen 4, by which the recording surface of the recording sheet 6 is maintained flat along the platen 4.

Faced to the recording surface of the recording sheet 6 established by the platen 4, an ink Jet recording head 1 mounted on the carriage 2 is positioned. More particularly, the carriage 2 is slidably engaged with a guide shaft 3 and a rear guide shaft 45 extending parallel with the platen 4 between the unshown left and right side plates at the opposite ends of a frame 44 of the printer. The carriage 2 is connected with a part of a timing belt 47 extended parallel with the guide shaft 2 around pulleys at the opposite ends of the printer. By this, the carriage 2 is moved along the guide shaft 3 and the rear guide shaft 45 by a carriage motor 46 through the timing belt 47. Together with the movement, the ink jet recording head 1 effects its recording operation. The recording head is driven for recording by recording signals supplied from a controller provided on a print board through a recording head cable 48.

The ink ejected by he driving of the recording head is supplied from an ink cartridge 27 through an ink tube 50 and a subordinate container 51 to the ink jet recording head 1. At a position adjacent to a recording region covered by the movable range of the ink jet recording head 1, a recovery means 52 is disposed which includes a cap 13 movable toward and away from the ink ejection side of the ink jet recording head 1 and an unshown pump for sucking the ink from the ink ejection outlets through the cap 13. Adjacent to the recovery means 52 and along the moving path of the recording head 1, there is provided a wiper 26 for removing residual ink, water droplet, dust or the like deposited on the ink ejection side surface of the ink jet recording head 1.

Designated by a reference numeral 11 is a home position sensor for discriminating a position of the movable recording head 1, wherein the position when the sensor 11 detects a part of the carriage 2 is deemed as a home position, that is, a reference position for the control of the movement of the ink jet recording head. Designated by a reference numeral 53 is an ink cartridge sensor for discriminating whether the ink cartridge 27 for supplying the ink is loaded or not.

FIG. 17 is a side view of the recovery means 52 of FIG. 16 in detail. The cap 13 faced to the ejection side of the ink jet recording head 1 and the pump 24 for sucking the ink &re movable by a rotation of a pump cam 23 in left-right directions and up-down directions in the Figure, respectively. The pump cam 23 is driven by an unshown pump motor. In order to discriminate the rotational position of the pump cam 23, a recovery means home position sensor 54 is mounted at a side of the pump cam 23. The home position sensor 11 is detected while the pump cam 23 is rotated, and the rotational position upon the detection is stored, and the operations of the cap 13 and the pump 24 are controlled on the basis of rotation degree from the stored position.

With this structure, however, the leads for the sensors for various discriminations in the recording apparatus are scatteredly disposed, and therefore, the wiring from the sensor to the print board 49 having a controller for controlling the apparatus in accordance with the detections of the sensors, is complicated. The wiring is further made complicated due to the existence of the recording head cable 48 for supplying the recording signal to the ink jet recording head 1, with the result of difficulty in servicing. The complicated wiring results in an expensive apparatus, together with the necessity of the long leads.

Furthermore, when the structure of the apparatus is complicated, the mechanism for detecting presence or absence of an ink cassette which is detachably mountable to the recording apparatus is a problem.

SUMMARY OF THE INVENTION

Accordingly, it is a principal object of the present invention to provide a recording apparatus provided with detecting means on the carriage, and the various conditions of the apparatus are discriminated on the basis of the detections by the detecting means at predetermined carriage positions, by which the wiring for the various sensors are not scatteredly arranged, so that the servicing operations and the assembling operations are made easier.

According to this aspect of the present invention, there is provided a recording apparatus for affecting a recording operation on a recording material while a recording head is being moved, and wherein a plurality of detecting means for detecting plural conditions of the apparatus, and the apparatus is controlled in accordance with the outputs of the detecting means, and wherein the plurality of said detecting means comprises one detecting element movable together with the recording head and the plurality of members to be detected disposed along the movable path of the detecting element, corresponding to the respective conditions. With the apparatus of this structure, various conditions of the apparatus can be detected together with the movement of the recording head, and in addition, the detection signals may be transmitted along the wiring path for driving the recording head.

It is another object of the present invention to provide a recording apparatus wherein one driving source is selectively operated for plural functions in interrelation with the movement of the carriage outside its recording region.

In this aspect of the present invention, there is provided a recording apparatus having a carriage and a recording head thereon, wherein the recording operation is performed while the carriage is being moved along the recording material, and a driving source for feeding the recording material in a direction substantially perpendicular to the carriage movement direction, comprising a plurality of gears driven by the driving source and arranged in a direction parallel to the movement direction of the carriage, and a gear member which is engageable with the carriage outside the recording region and which is selectively engageable with one of the plural gears corresponding to a position of the carriage, wherein the recording material can be fed with the gear member meshed with one of the plural gears, and an operation other than the recording material feeding is possible when it is meshed with another one of the plural gears.

According to this aspect of the present invention, the gear member engageable with the carriage when the carriage is outside the recording region is meshed with selected one of the plural gears corresponding to the carriage position, and therefore, the recording material can be fed using one of the plural gears, and another operation is possible with the same driving force by the meshing engagement with the gear member with another one of the plural gears at a different position of the carriage. Thus, different operations can be performed with a single driving source without necessity of a complicated mechanism.

Another aspect of the present invention deals with a problem that when a movable member is detected along its movement path as in the first aspect of the present invention and if a member or members to be detected which is movable toward and away from the path, the movement of the movable member can be affected depending on the position of the members to be detected. According to this aspect of the present invention, an ink cassette (movable member) detachably mounted in the recording apparatus is provided with a stopper mechanism.

It is a further object of the present invention to provide a small size recording apparatus by improving an ink cassette detecting mechanism.

It is a further object of the present invention to provide a recording apparatus improved in one or more of the aspects described above.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 24A, 24B, 25A and 25B illustrate a mechanism for detecting an ink cassette, wherein FIGS. 24A and 25A show it before the ink cassette is loaded into the apparatus; and FIG. 24B and 25B show the ink cassette after it is loaded.

DESCRIPTION OF THE PREFERRED EMBODIMENT

Referring to the accompanying drawings, the preferred embodiments of the present invention will be described in detail.

Figure 15:
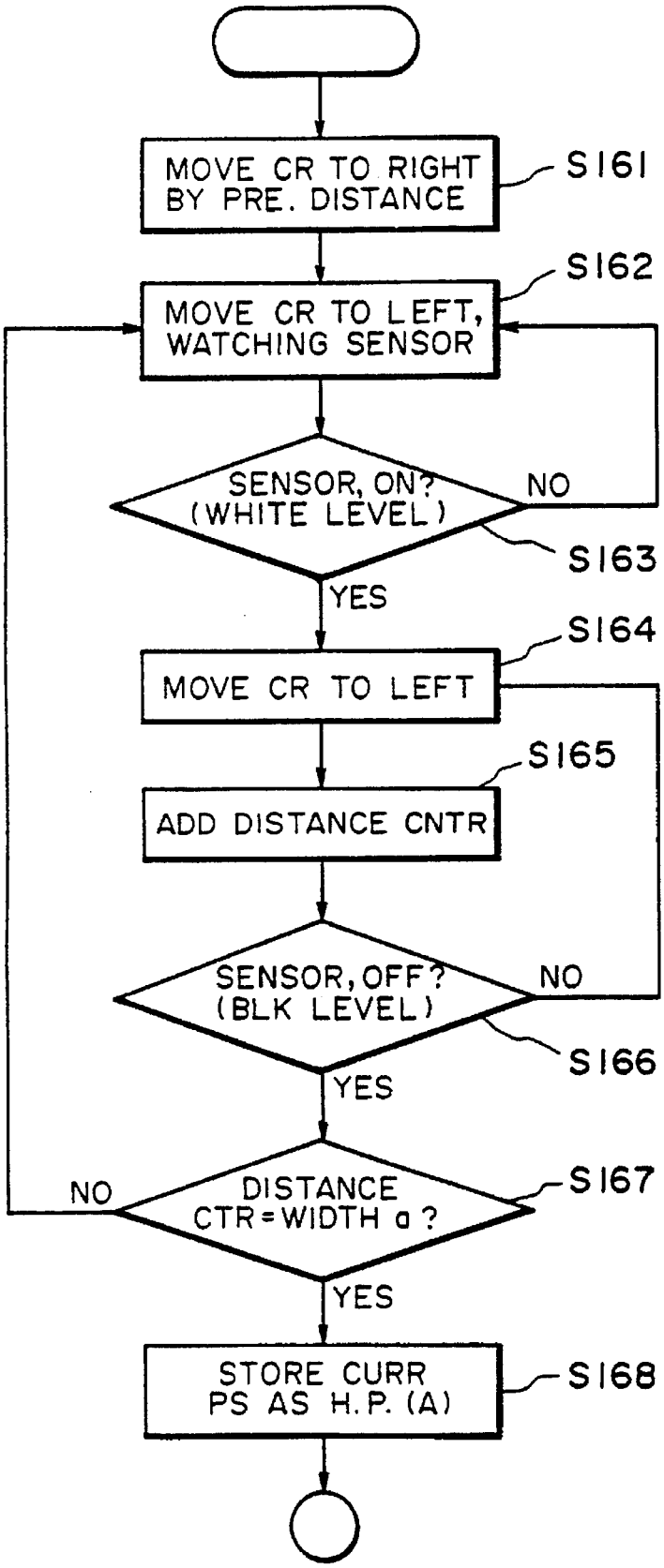
FIG. 15 is a flow chart illustrating an operation of the detecting means shown in FIG. 14.
Figure 16:
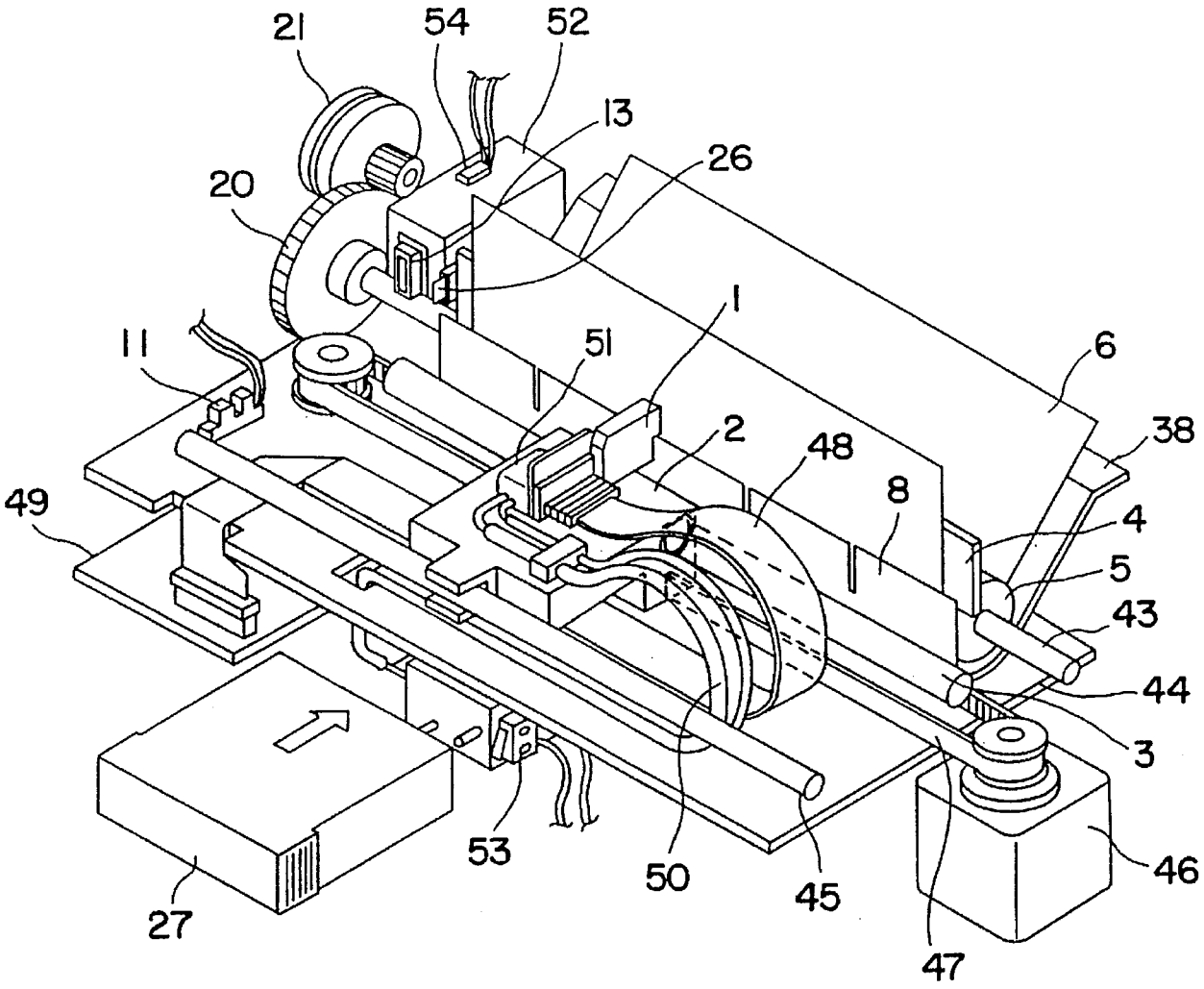
FIG. 16 PRIOR ART
FIGS. 16 and 17 are a perspective view and a partial side view of a conventional ink jet printer.
Figure 17:
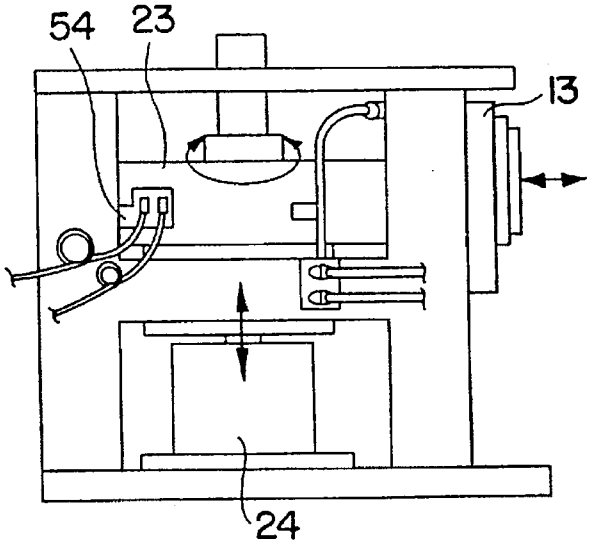
FIG. 17 PRIOR ART

In the following, an ink jet printer is described, similarly to the description of the conventional apparatus, and therefore, in FIGS. 1–15, the same reference numerals as in FIGS. 16 and 17 are assigned to similar elements, and the detailed description thereof are omitted for simplicity.

FIGS. 1–7 illustrate detecting means for an ink jet printer according to a first embodiment of the present invention.

Figure 1:
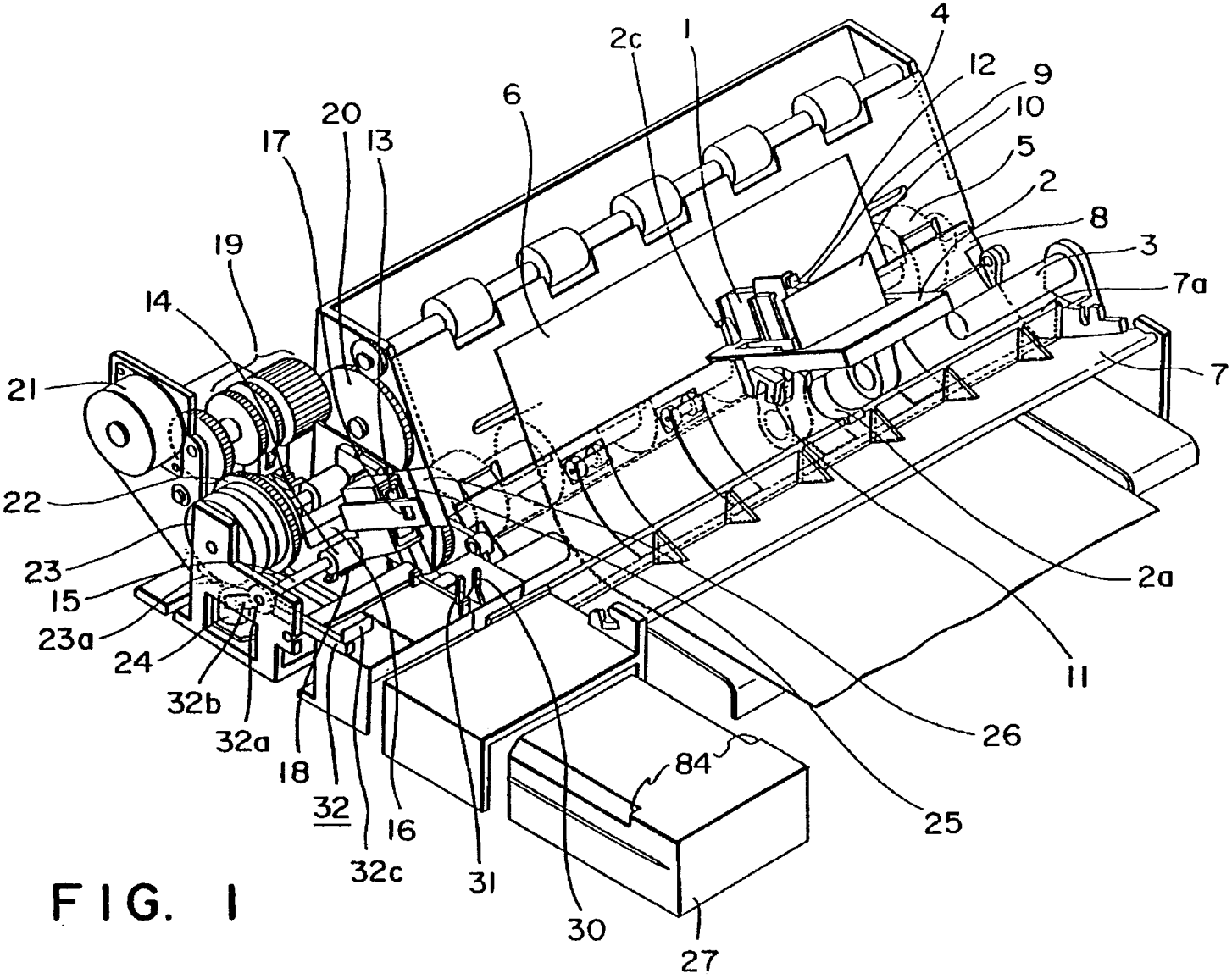
FIG. 1 is a perspective view of an entire ink jet printer according to an embodiment of the present invention.
Figure 2:
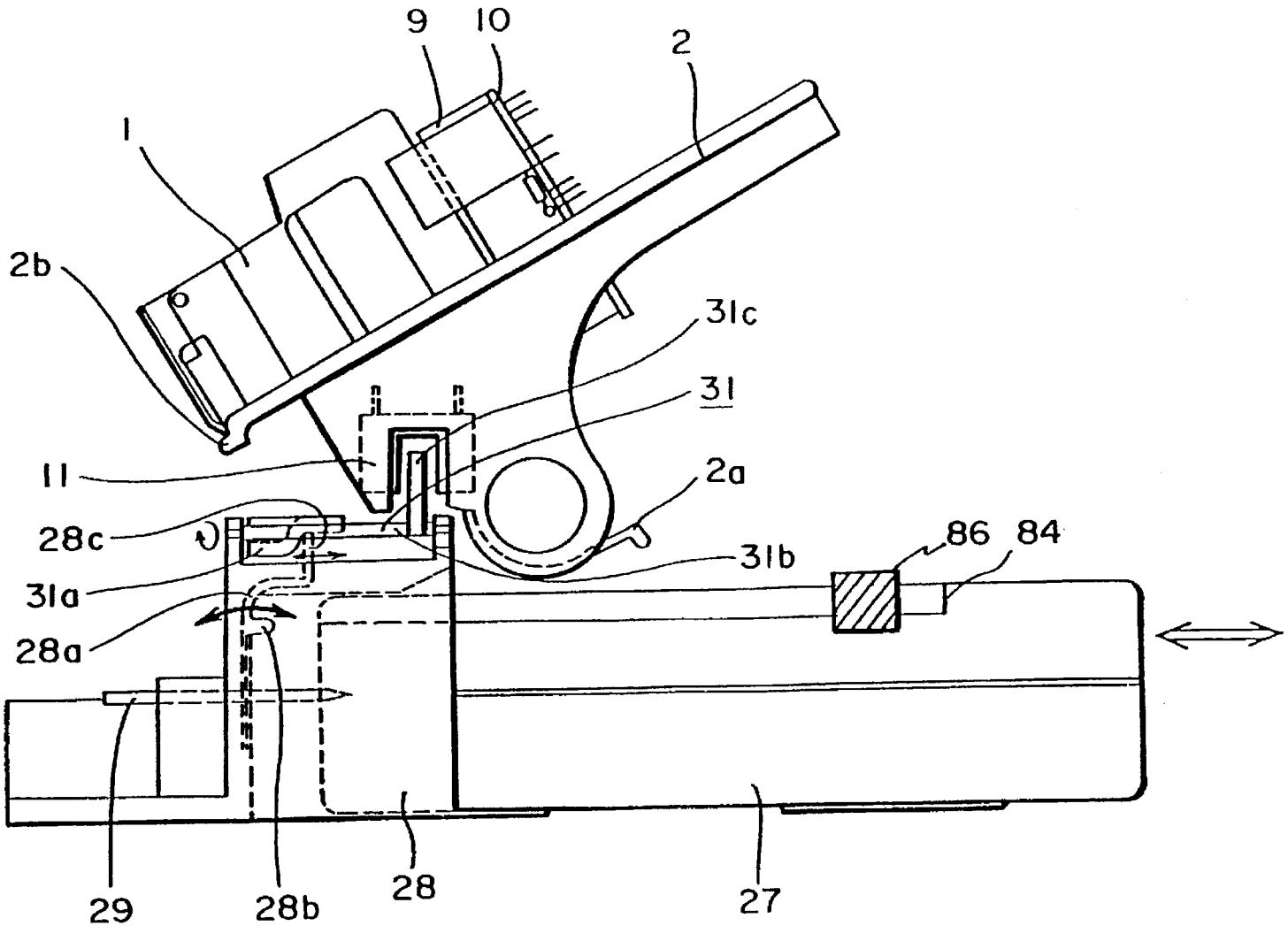
FIG. 2 is a side view of a carriage and an ink cartridge in the apparatus of FIG. 1.
Figure 3:
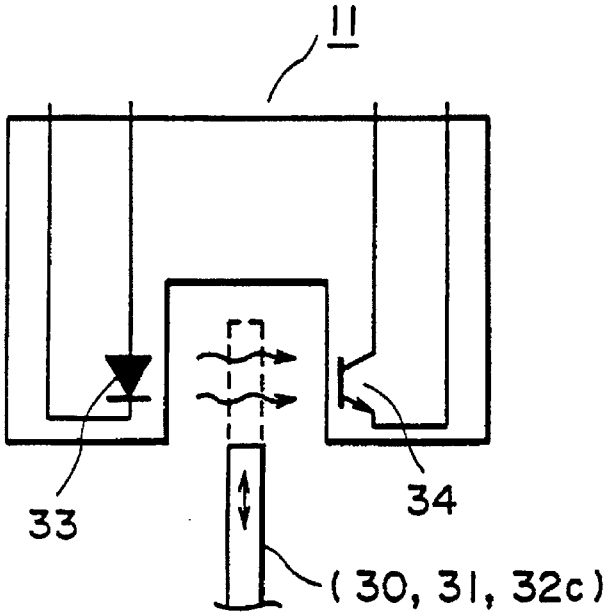
FIG. 3 is a somewhat schematic view illustrating a transparent type sensor.
Figure 4:
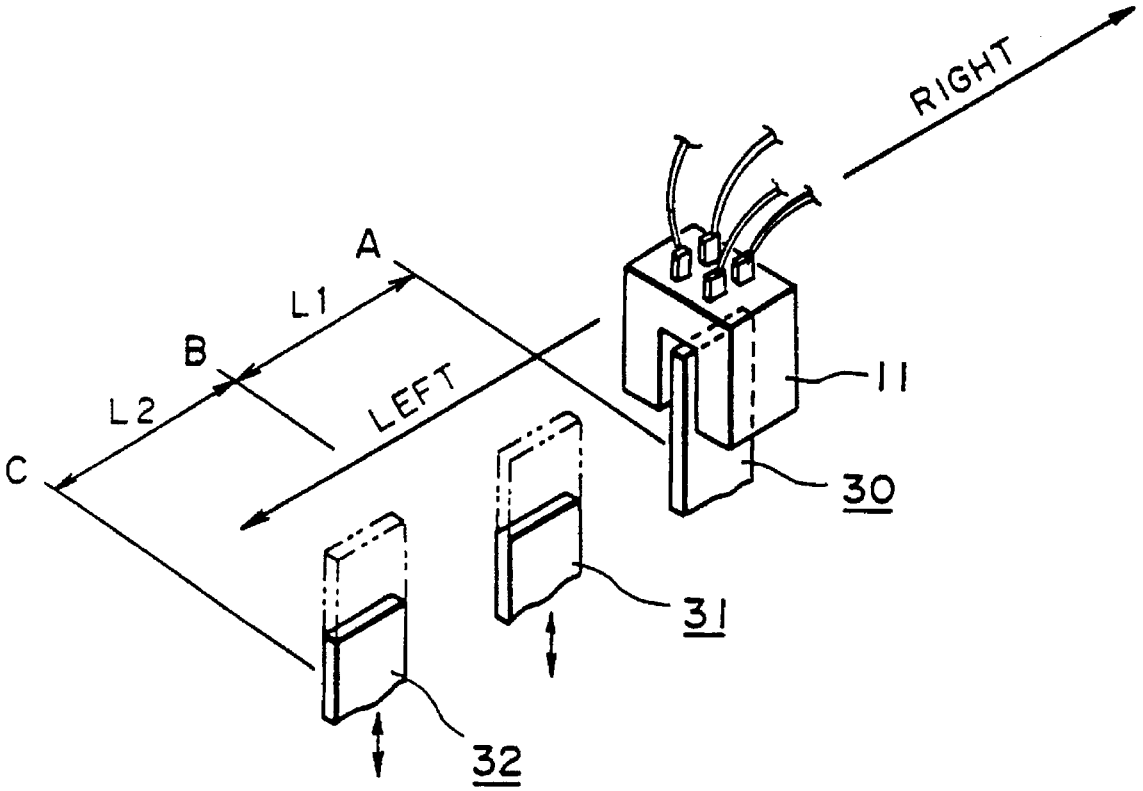
FIG. 4 is a somewhat schematic perspective view illustrating an operation of detecting means.
Figure 5:
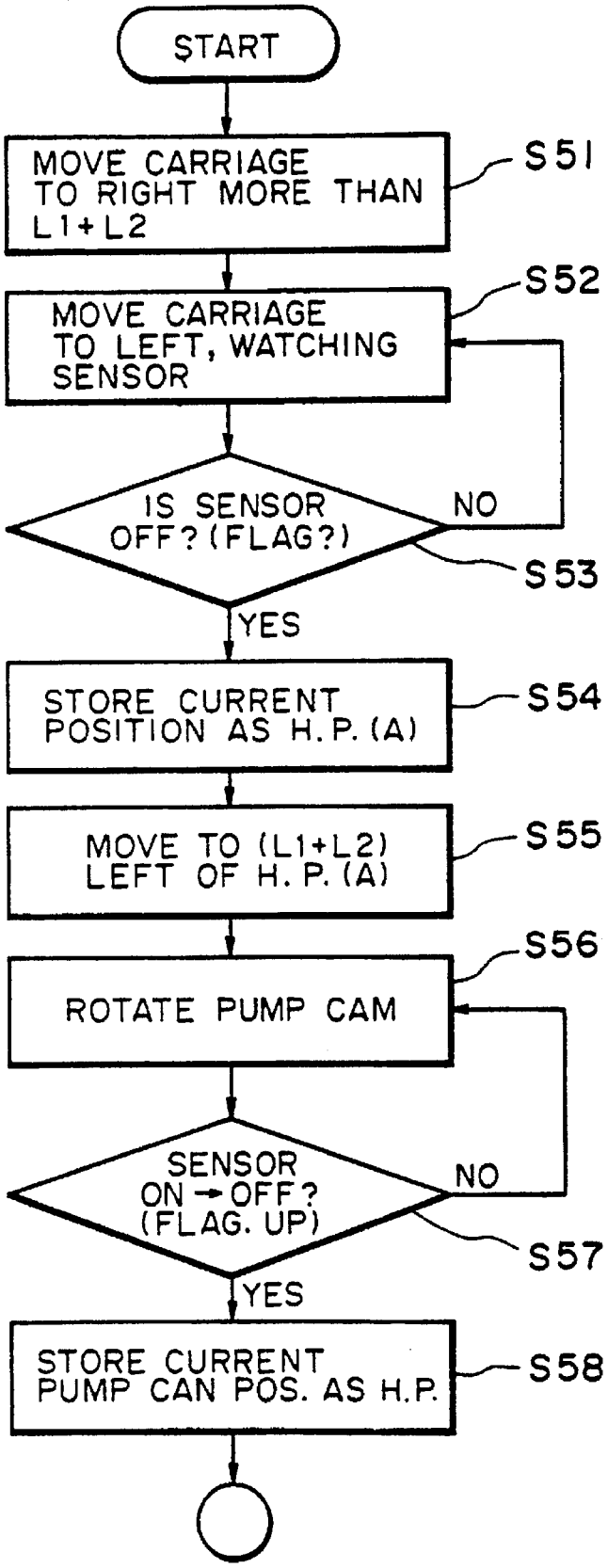
FIG. 5 is a control flow chart of detecting means shown in FIG. 4.
Figure 6:
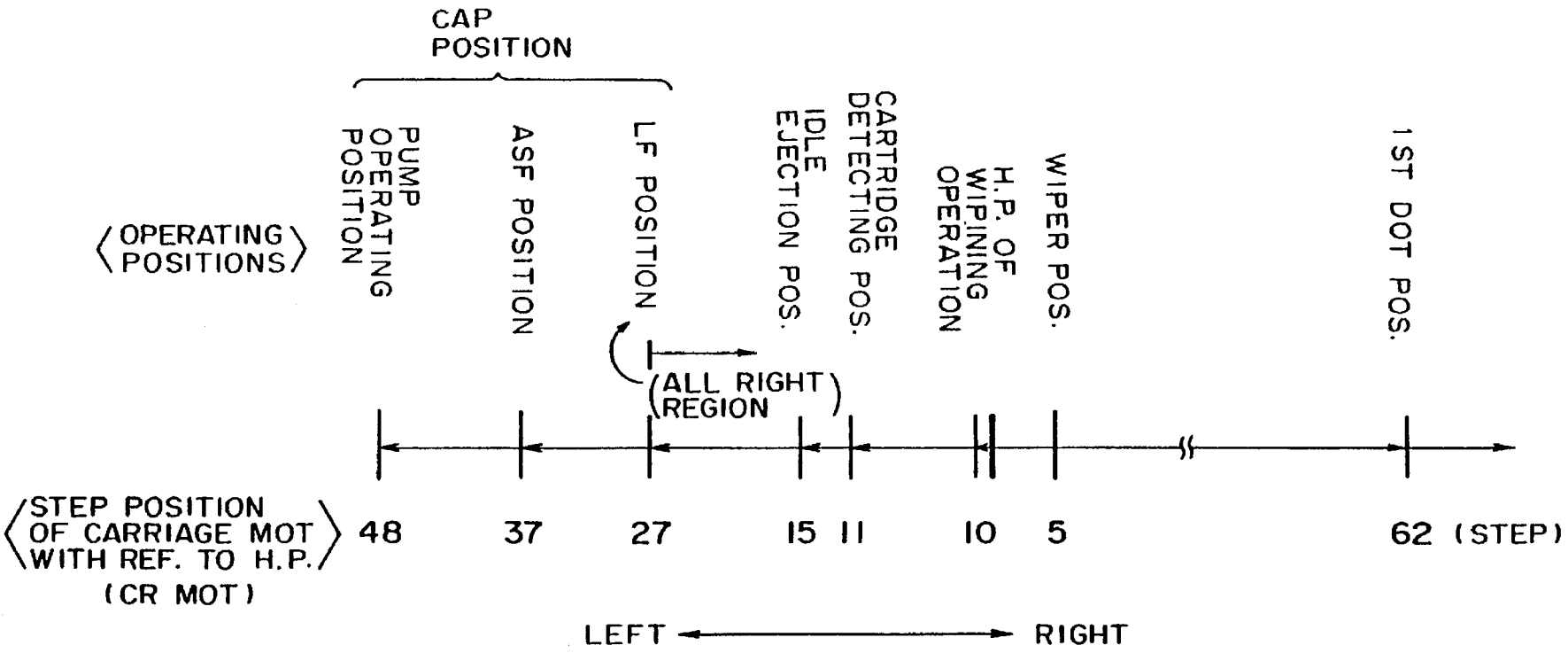
FIG. 6 is a diagram illustrating an operation of the ink jet printer.
Figure 7:
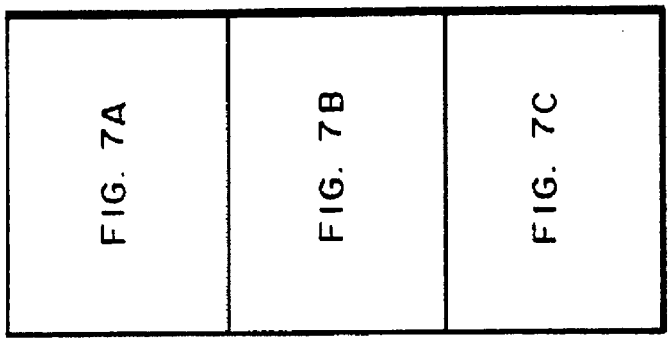
FIGS. 7, 7A, 7B and 7C are flow charts illustrating control operation shown in FIG. 6.
Figure 7C:
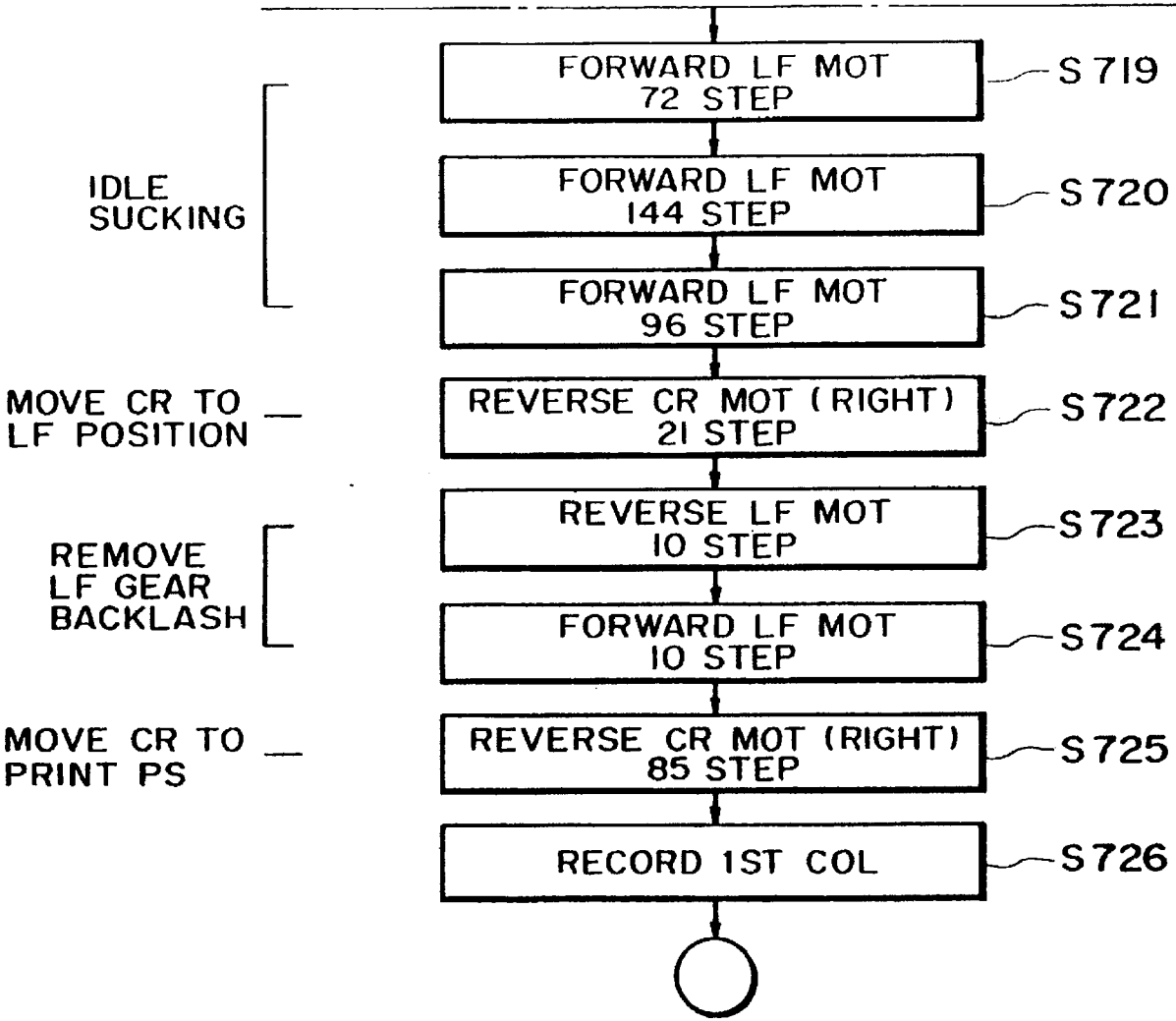
Figure 7A:
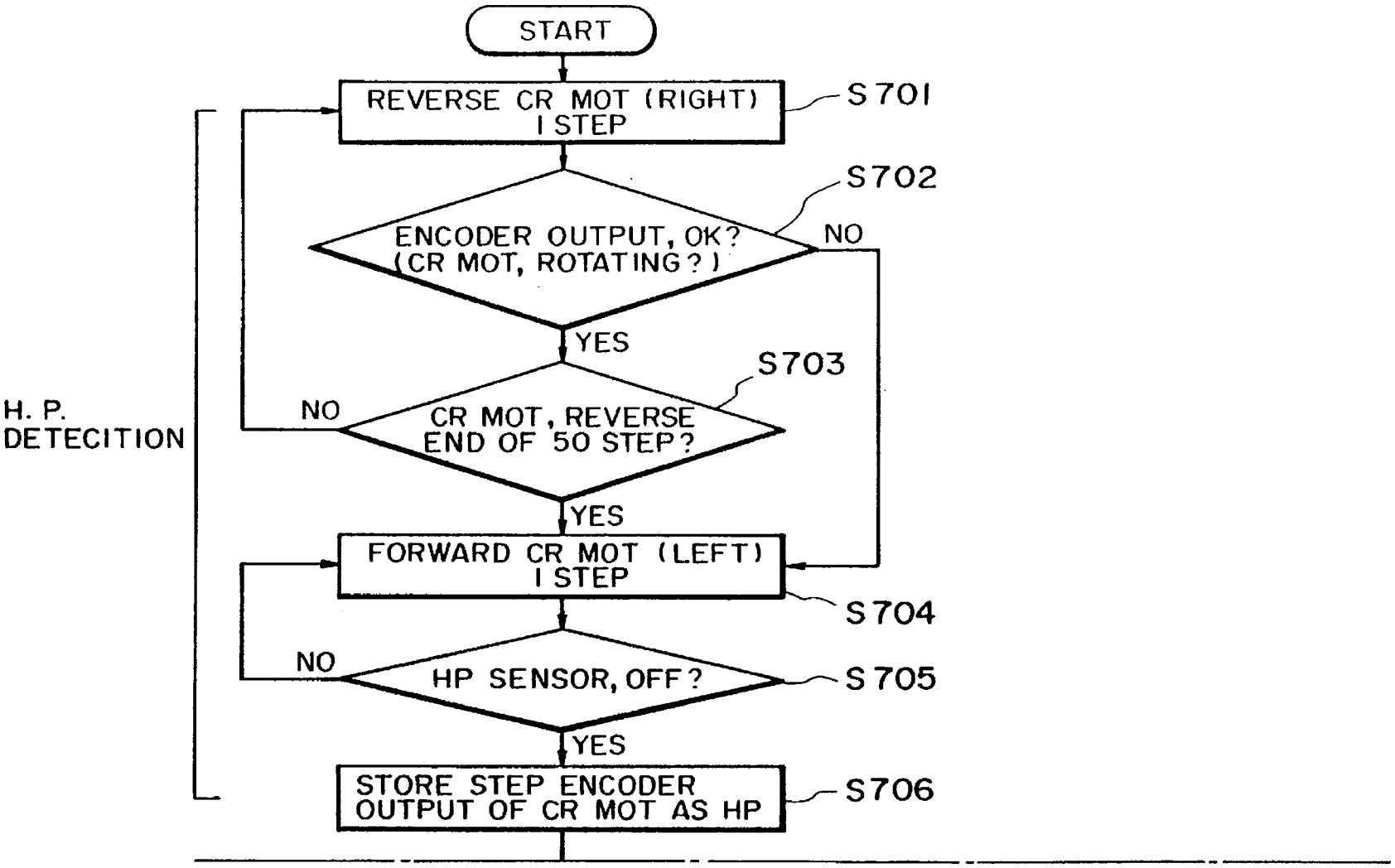
Figure 7B:
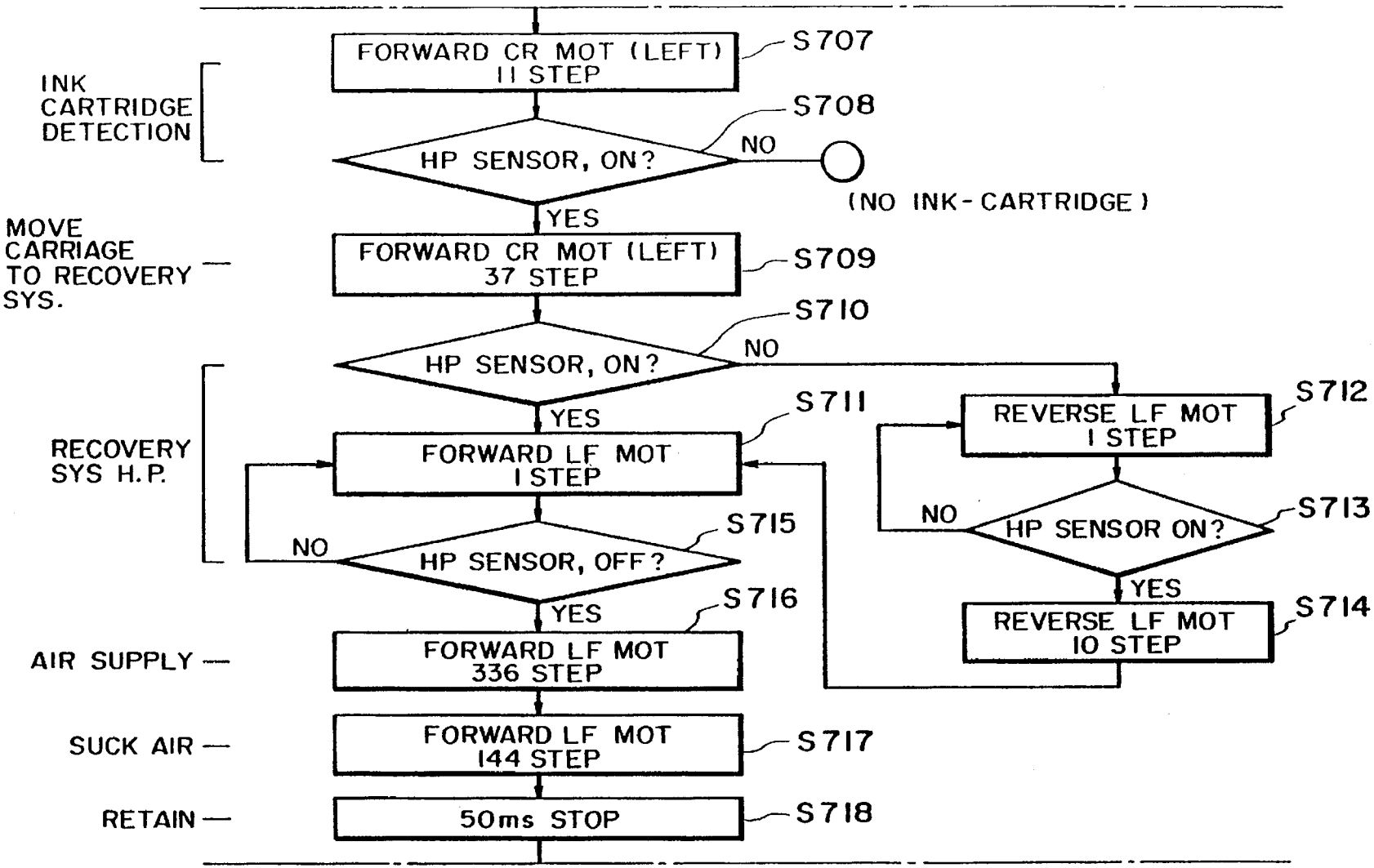

FIG. 1 is a perspective view of an ink jet printer illustrating the general arrangement thereof. FIG. 2 is a side view of a carriage and an ink cartridge of the ink jet printer. FIG. 3 is a somewhat schematic top plan view to illustrate an operational principle of a transparent type sensor of detecting means used in this embodiment. FIG. 4 is a perspective view illustrating a fundamental operation of the detecting means. FIG. 5 is a flow chart illustrating control steps for the detecting means. FIG. 6 shows a relationship between a position of the carriage having the detecting means and various operations. FIGS. 7A and 7B are flow charts illustrating the control steps.

As shown in FIGS. 1 and 2, an ink jet recording head 1 is mounted on a carriage 2 which is movable along a guide shaft 3 while the ejection side of the head 1 is faced to a platen 4. To the platen 4, a recording sheet 6 is supplied by rotation of a friction roller 5, so that the recording head 1 effects recording on the recording sheet 6. The carriage 2 has an integrally formed spring member 2*a* which is slidably engaged with a rail 7*a* disposed on a paper guide 7. By the engagement of the spring member 2*a* with the rail 7*a*, the carriage 2 is urged in a rotational direction about the guiding shaft 3. The carriage 2 is provided with an abutment portion 2*b* at its platen side. By the rotational urging by the spring member 2*a*, the abutment portion 2*b* is abutted to a sheet confining plate 8. As will be understood, the carriage 2 travels while the abutment portion 2*b* is in sliding contact with the sheet confining plate 8, and therefore, the ink jet recording head 1 is maintained spaced from the recording sheet 6 with a predetermined gap. Therefore, a stabilized recording operation is possible.

Adjacent a rear side of the ink jet recording head 1, electric contacts are provided to receive recording signals. The contacts are electrically connected to a head connector 9. The head connector 9 is mounted on a head print board 10. The head print board 10 is electrically connected with an unshown print board by an unshown head cable. The carriage 2 is also provided with a home position sensor 11 in the form of a light transparent type sensor and a sheet width detecting sensor 12 in the form of a light reflection type sensor. The home position sensor 11 functions to discriminate various conditions in the recording apparatus. The sheet width detecting sensor 12 functions to detect a width of the recording sheet 6 by the difference in the light reflection from the recording sheet 6 and from the other portion.

A cap of a recovery means is mounted on a recovering means moving portion 14. Together with the movement of the recovering means moving portion 14 along the recovering means shaft 15, the cap 13 is moved toward and away from an ink ejection side of the ink jet recording head 1 by way of movement of a cam 16 disposed behind the cap 14, so that the capping state and non-capping-state are selectively established. The leftward movement of the recovery means moving portion 14 in FIG. 1 is provided by engagement of an arm 17 of the recovering means with a projection 2*c* of the carriage 2 when the carriage is moved to the left. 0n the other hand, the movement of the recovering means moving portion 14 to the right is effected by urging force to the right by a spring 18.

Designated by a reference numeral 19 is a switchable transmission gear train which establishes different transmission pads to switch the transmission in accordance with positions of the carriage 2 and the recovery means moving portion 14. More particularly, the driving force of the feed motor 21 is transmitted to an intermediate feed gear 20 through the transmission gear train 19 to rotate the friction roller 5. On the other hand, the driving force of the feed motor 21 is transmitted to the pump gear 22 through the gear train 19 to-rotate the pump cam 23 formed integrally, by which the pump 24 is driven.

Within the movable region of the ink jet recording head 1, and at a position adjacent to the gap 13, absorbing means 25 and a wiper 26 are provided. When the recording head 1 is moved, the absorbing means 25 absorbs water droplets or the like on the surface of the recording head at the ejection side, and the wiper 26 removes dust or residual ink thereon.

Adjacent the left-hand end in the recording head movable region, a cartridge guide 28 is disposed, along which an ink cartridge 27 is mounted into or dismounted from the apparatus, during which a needle 29 fixed on the cartridge guide 28 pierces the cartridge or is pulled out therefrom. The ink in the ink cartridge 27 is supplied to the ink jet recording head 1 through an unshown ink tube. On the cartridge guide 28, a home position detecting flag 30 is mounted at a 5 fixed position to determine a position of the carriage 2. The home position flag 30 is disposed at a slit of the home position sensor 11 of the carriage 2, by the movement of the carriage 2. By this, the home position is detected. Similarly, to the left, in FIG. 1, of the home position detecting flag 30 on the cartridge guide 28, there is an ink cartridge detecting flag 31. When the ink cartridge 27 is inserted on the cartridge guide 28, a projection 28*b* of an ink cartridge lever 28*a* formed integrally with the cartridge guide 28 is pressed, by which the ink cartridge lever 28*a* is resiliently flexed, and therefore, its leading end 28*c* is moved backwardly. By this, a cam 31*a* of the ink cartridge detecting flag 31 is urged upwardly, and similarly, the ink cartridge detecting flag 31 is rotated about the shaft 31*b* of the flag 31, so that the flag 31*c* is unset (laid down). As a result, when the flag 31*c* is set (upright), the home position sensor 11 is switched from its on-state to off-state by the movement of the carriage 2, so that the absence of the ink cartridge 27 is detected.

The home position detecting flag 32 for the recovery means is mounted for rotation about a pivot 32*a* disposed behind the cartridge guide 28 in FIG. 1. The detecting flag 32 has a flag portion 32*c* and a lever portion 32*b* formed at a position across the pivot 32*a* from flag portion 32*c*. When the lever portion 32*b* is lowered by a pump cam projection 23*a* of the pump cam 23, the flag portion 32*c* is set into a moving path of the carriage 2. By this, the sensor 11 and the flag portion 32*c* are engaged by the movement of the carriage 2, and therefore, it is detected that the recovering means is at its home position. If it is not at the home position, the flag portion 32*c* is not set, and therefore, the recovery means is not detected.

The home position sensor 11 used in this embodiment is a light transmitting type sensor, as shown in FIG. 3.

Normally, the light emitted from an emitting element 33 is received by a light receiving element 34, so that the sensor is in the on-state. When the flag is set into the slit, the light emitted from the emitting element 33 is blocked, so that the electric current through the light receiving element 34 is stopped (sensor becomes off-state), so that the presence of the flag can be detected.

Referring to FIGS. 4 and 5, an example of control for detecting various conditions will be described. FIG. 5 is a flow chart of initial processing steps in the ink jet printer.

As shown in FIG. 4, the home position detecting fixed flag 30, the ink cartridge detecting flag 31 and the recovering means home position detecting flag 32 are disposed in the order named from the right-hand side of FIG. 4. In order to detect the home position detecting flag 30 to detect the initial position of the recording head 1 at first, the carriage 2 is moved to the right in FIG. 4 through a distance not less than (L1+L2) at step S51, and thereafter, the carriage 2 is moved to the left at step S52. Then, at step 853, the carriage 2 is moved while discriminating whether the flag is detected or not. When the flag is detected, it is discriminated that the first detected flag is the home position detecting fixed flag 30. At step S54, the position is stored as a home position A. Then, at step S55, the carriage 2 is moved to the left from the home position A through a distance which is approximately (L1+L2), by which the home position sensor 11 is moved to a position C in the Figure, that is, the position where the flag portion 32*c* of the recovery means home position detecting flag 32 can be detected. Here, the carriage 2 is retained at the current position C, and the pump cam 23 is rotated at the next step S56. By the rotation, the flag portion 32*c* of the recovery means home position detecting flag 32 is detected (step S57), and then, the position is stored as the home position of the pump cam 23 at step S58.

After the initial operation is completed, the carriage 2 and the pump cam 23 are controlled on the basis of the stored home positions by movement or rotation through known degrees with the reference of the home positions. When the carriage 2 is moved until the home position sensor 11 reaches the position B, the state of the home position sensor 11 is checked, by which the discrimination is made as to whether or not the ink cartridge 27 is mounted.

In the ink jet printer of the first embodiment of the present invention, a carriage motor (CR motor) is used to move the carriage 2 with reference to the home position of the recording head 1. FIG. 6 shows the relationship between the step numbers of the carriage motor (angular position) and the operations corresponding thereto.

FIGS. 7A and 7B are flow charts illustrating the control steps performed on the basis of the positions of the carriage 2 from the initial operation of the ink jet printer to the first column recording. The carriage motor (CR motor) is provided with an encoder for detecting the rotational position thereof.

The flow charts will be described. At steps S701, S702 and S703, the carriage motor is rotated through 50 steps while checking an output of the encoder at each of the steps, by which the carriage 2 is moved to the right (as seen in FIG. 6). When the carriage 2 before the initial processing is within 50 steps from the right end of the apparatus, the carriage 2 stops by abutment to the right end, and therefore, the carriage motor is no longer rotated with the result of unchanged output of the encoder. In this case, the reverse drive of the carriage motor is terminated at this time, and the operation proceeds in the manner similar to the case in which the 50 step movement is completed. Next, at steps S704 and S705, the carriage motor is rotated in the forward direction one by one step, so that the carriage 2 moved to the left until the home position sensor 11 detects the home position detecting flag 30, and when the flag 30 is detected, the position at this time is-stored as the home position at step S706.

At steps S707 and S708, the carriage motor is rotated forwardly through 11 steps to move the carriage 2 to an ink cartridge detecting position, where the state of the home position sensor 11 is checked. When the flag portion 31*c* of the ink cartridge detecting flag 31 is detected, that is, when the sensor 11 is in off-state, it is discriminated that the ink cartridge 27 is not mounted, and the operation flow branches out to an error routine for the case of the absence of the ink cartridge. When the flag portion 31*c* is not detected, that is, when the sensor 11 is in on-state, it is discriminated that the ink cartridge 27 is mounted, and the subsequent steps are executed.

At step S709, the carriage motor is rotated in the forward direction through 37 steps further, so that the carriage 2 is moved to the pump operating position. At this position, the transmission path of the switchable transmission gear train 19 is for the pump gear 22, and therefore, the rotation of the feed motor 21 (LF motor) rotates the pump cam 23 through the pump gear 22. While the carriage 2 is being retained at this position, the state of the home position sensor 11 is detected at step S710. When the flag portion 32*c* of the recovery means home position detecting flag 32 is detected, that is, when the sensor 11 is in the off-state, the feed motor 21 is once reversely rotated at step S712, S713 and S714 to establish the state of no flag portion (32*c* detection). After this state is established, or when the flag portion 32*c* is not detected at the step S710, the feed motor 21 is rotated in the forward direction at steps S714 and S715. The position where the home position sensor 11 detects the recovery means home position detecting flag 32 is stored as the home position of the recovery means.

Further, at steps S716–S721, the feed motor is rotated forward further with reference to the home position of the recovery means while the carriage 2 is retained at the position, and a series of recovery operations is performed, which includes a forced air supply operation, a suction operation, a suction state retaining operation and an idle suction operation. Then, at steps S722–S725, the carriage motor is rotated reversely through 21 steps to return the carriage 2 to the LF (line feed) operating position, by which the transmission path of the switchable transmission gear train 19 is switched to the intermediate feed gear 20. Then, the feed motor 21 is rotated reversely and forwardly, the adverse affect of the backlash of the gear is removed by shifting to one side. Thereafter, the recording operation is started at step S726 from the position after 88 step reverse rotation of the carriage motor.

Figure 8:
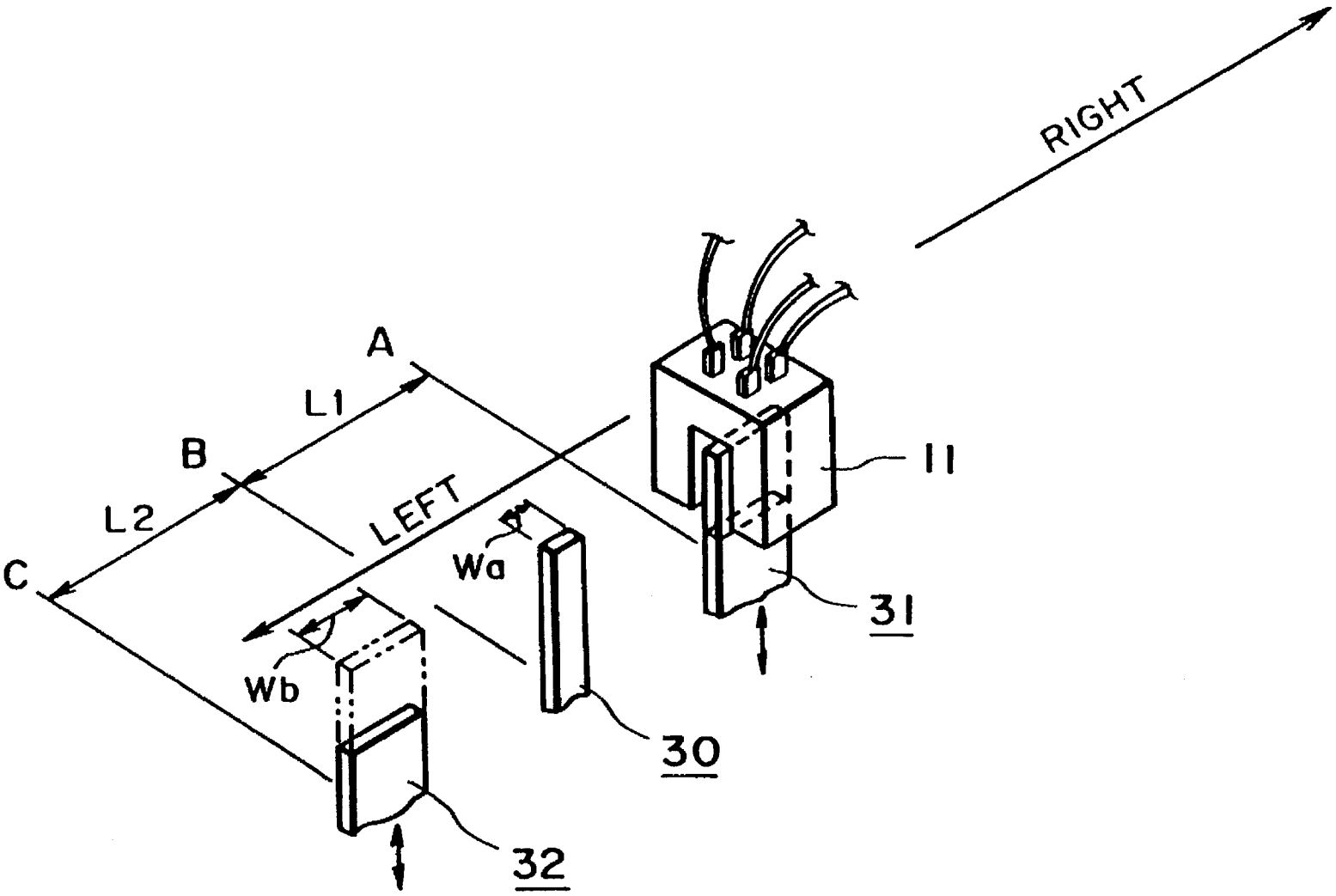
FIG. 8 is a somewhat schematic perspective view illustrating an operation of the detecting means according to a second embodiment of the present invention.
Figure 9:
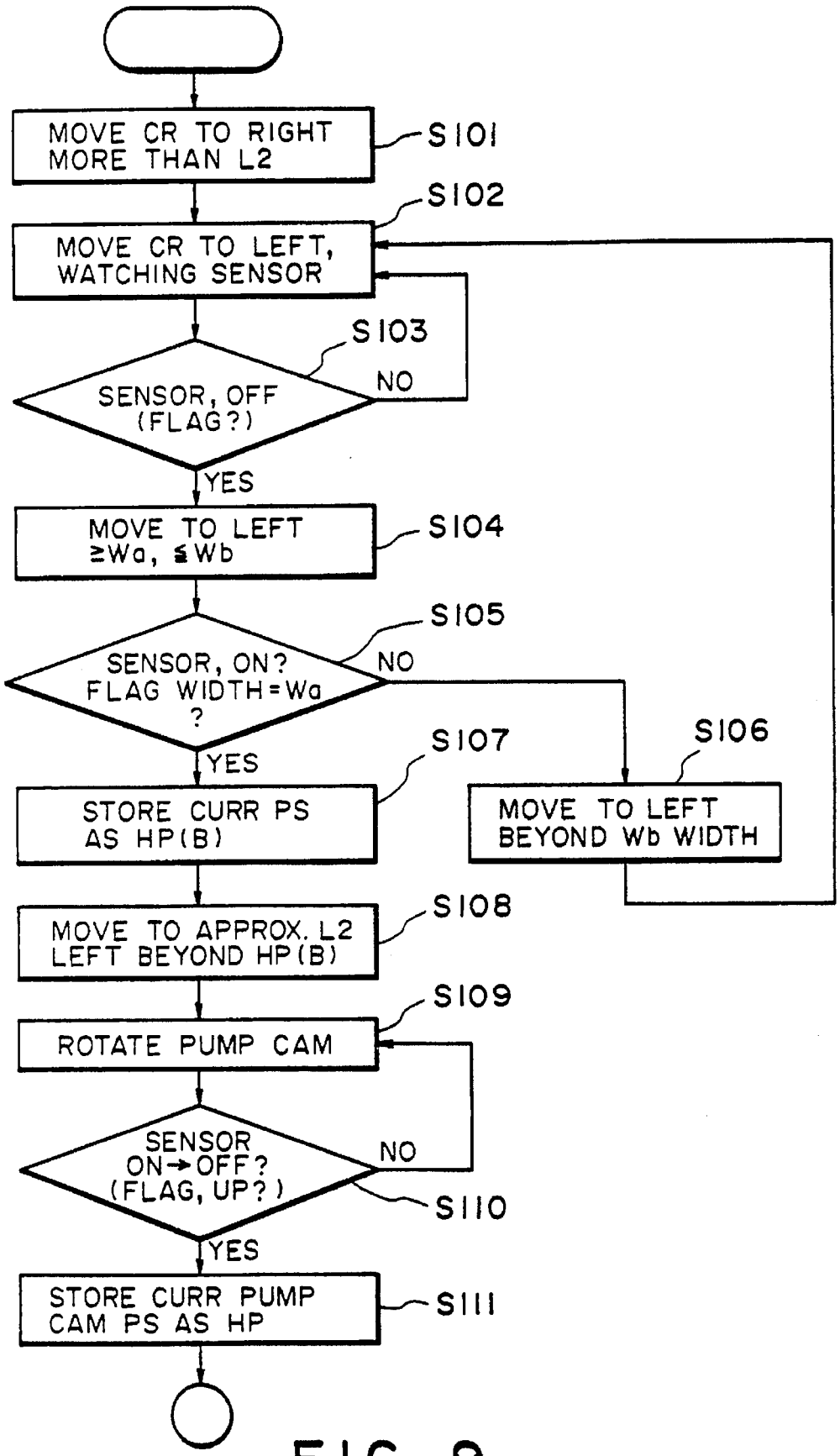
FIG. 9 is a flow chart illustrating an operation of the detecting means shown in FIG. 8.

FIGS. 8 and 9 are-somewhat schematic perspective views of an apparatus according to a second embodiment of the present invention and a flow chart illustrating the operation thereof.

FIG. 8 is similar to FIG. 4, but is different from FIG. 4 in that the home position detecting fixed flag 30 has a width Wa which is different from a width Wb of the recovery means home position detecting flag 32 and of the ink cartridge detecting flag 31. In FIG. 8, the width Wa is smaller than the width Wb. In FIG. 4, the home position detecting flag 30 is required to be at the right end. However, in this embodiment, the position of the home position detecting fixed flag 30 may be at any position relative to the ink cartridge detecting flag 31 and the recovery means home position detecting flag 32. In FIG. 8, the home position detecting fixed flag 30 is between the ink cartridge detecting flag 31 and the recovery means home position detecting flag 32.

Referring to the flow chart of FIG. 9, the initial operation of the ink jet printer of FIG. 8 will be described.

First, at step S101, the carriage 2 is moved through a distance not less than L2 to the right (as seen in FIG. 8). Next, at step S102, the carriage 2 is moved to the left while monitoring by the home position sensor 11 to detect-the position where the flag is switched from the non-detection state to the detection state. At step S103, the flag is detected, and then, the carriage is moved further to the left from the detection position (S104) through a predetermined distance which is not less than the width Wa approximately and not more than the width Wb to confirm the detection by the home position sensor 11. At step S105, the discrimination is made as to whether the width of the flag is Wa or Wb. If it is Wb, it is discriminated that the detected flag is the flag portion 31*c* of the ink cartridge detecting flag 31. Then the operation returns to the step S102 through the step S106 to move the carriage to the left. If the width of the flag is Wa, the detected flag is discriminated as being the home position detecting flag 30. Then, at step S107, the current position is stored as the home position B. Subsequently, at steps S108–S111, the carriage 2 is moved further to the left through a distance approximately L2, and the initial operation of the pump cam is performed.

Figure 10:
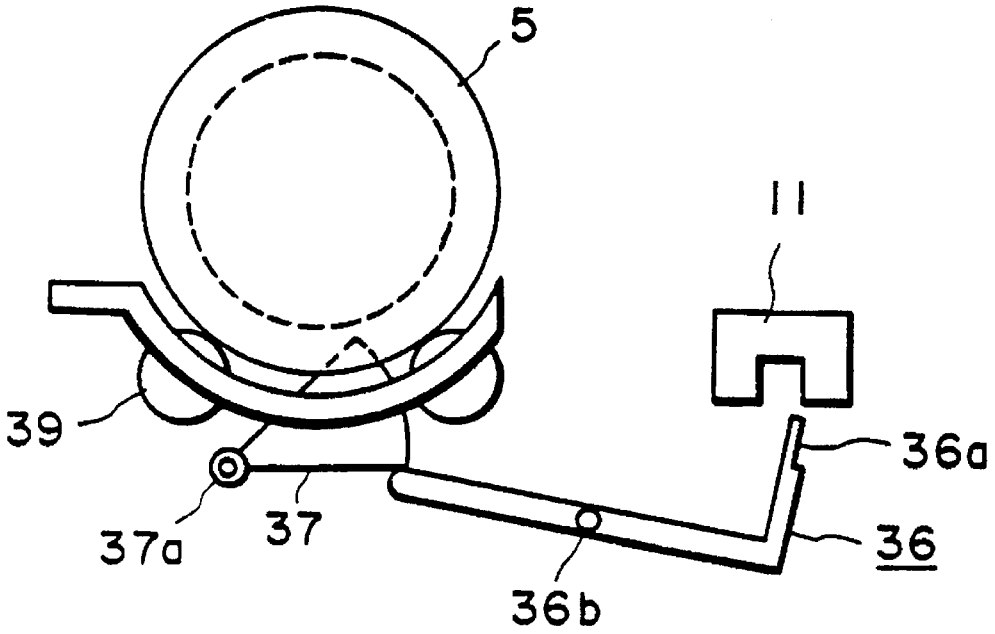
FIGS. 10 and 11 are sectional views illustrating detection of absence of the recording sheet according to a third embodiment of the present invention.
Figure 11:
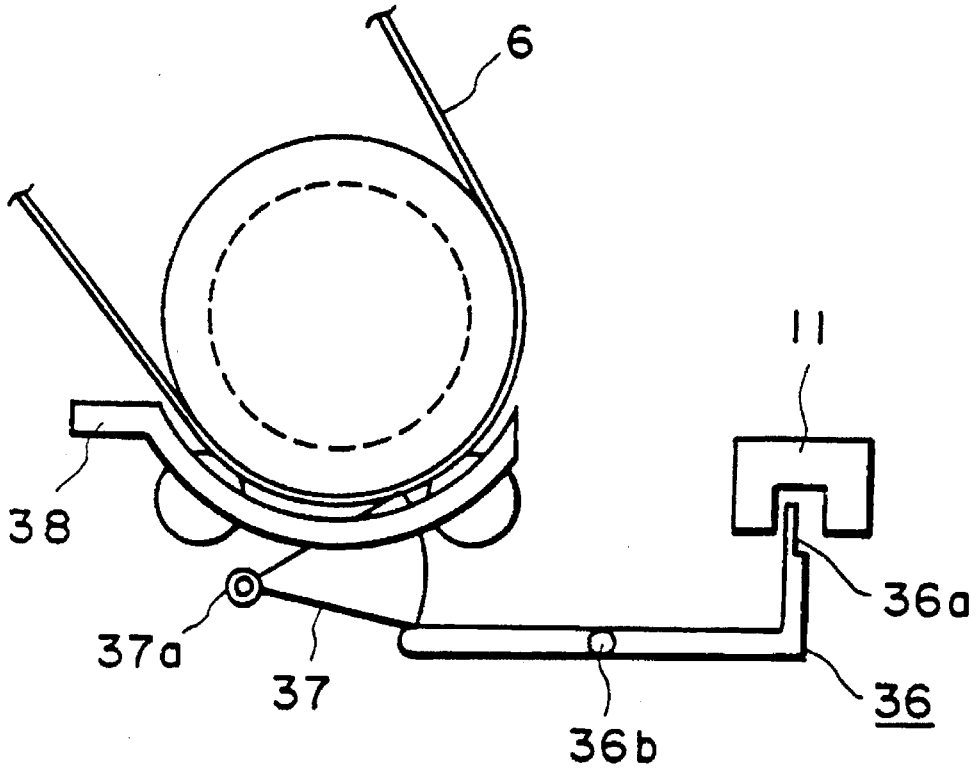
Figure 12:
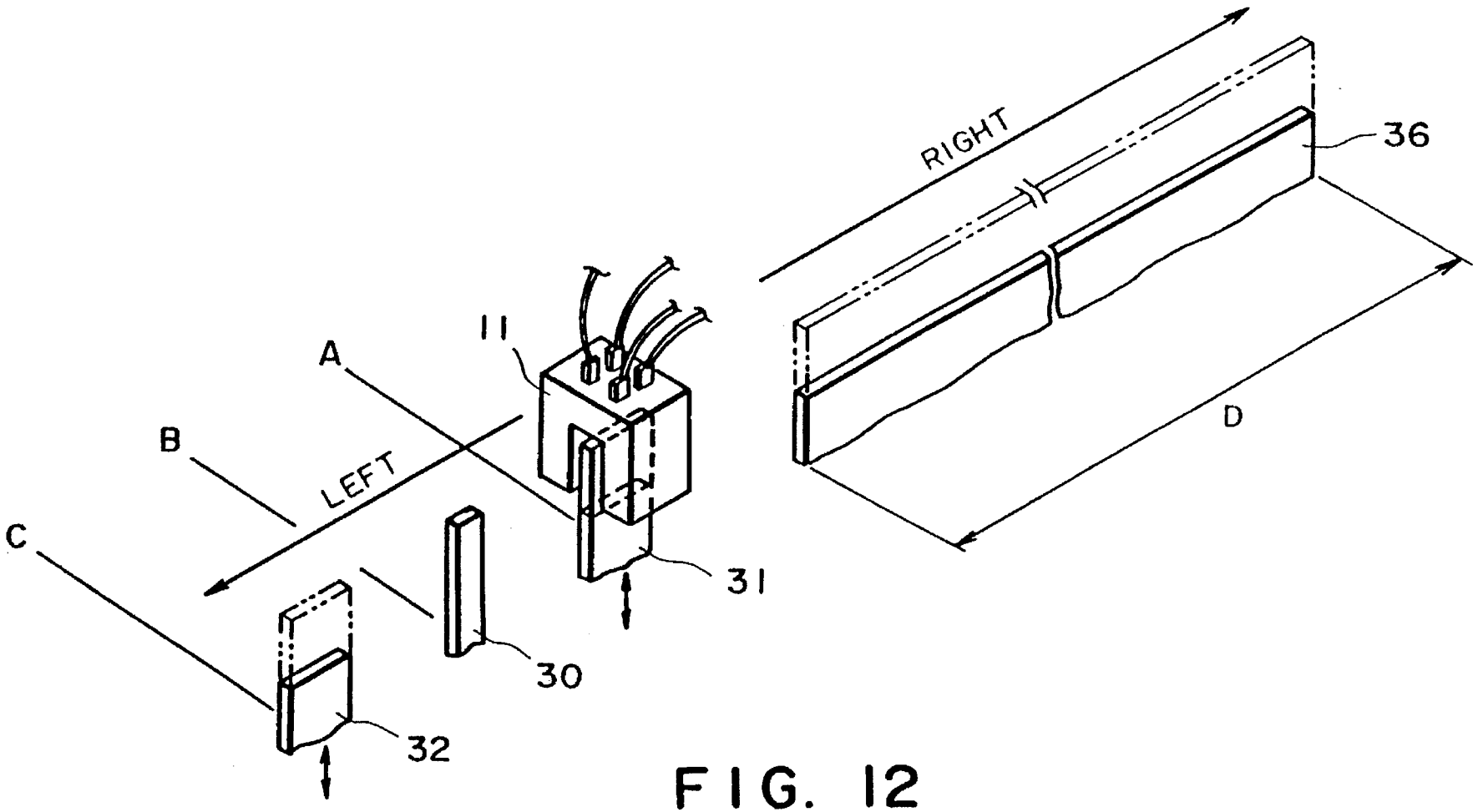
FIG. 12 is a somewhat schematic perspective view illustrating an operation of the detecting means shown in FIG. 11.

FIGS. 10–12 show a third embodiment of the present invention. FIGS. 10 and 11 are sectional views for illustrating the operation of a flag 36 for detecting absence of the recording sheet in this embodiment. FIG. 12 is a somewhat schematic perspective view illustrating the structure of the detecting means used in this-embodiment.

FIG. 10 shows the state in which there is no recording sheet; and FIG. 11 shows the state in which the recording sheet 6 is loaded. When the recording sheet 6 is not supplied, or when the trailing edge of the recording sheet 6 passes by a lever 37, the sheet absence lever 37 is not prevented from counterclockwise rotation in this Figure about the pivot 37*a*, and therefore, the sheet absence detecting flag 36 rotates in the clockwise direction about the pivot 36*b* by the weight of the flag portion 36*a* of the sheet absence detecting flag 36, by which the sheet absence lever 37 is raised by its rotation about the pivot 37*a*. In this state, the flag portion 36*a* of the sheet absence detecting flag 36 is out of the slit of the home position sensor 11.

As shown in FIG. 11, when the recording sheet 6 is supplied to between the friction roller 5 and the pinch roller 39 along the paper pan 38, the sheet absence lever 37 is lowered by the recording sheet 6. By the lowering of the sheet absence lever 37, the sheet absence detecting flag 36 is rotated clockwisely about the pivot 36*b*, and therefore, the flag portion 36*a* is inserted into the slit of the home position sensor As shown in FIG. 12, the sheet absence detecting flag 36 has the flag portion 36*a* having a width larger than those of the other three flags. By this, the detection is possible only when the sheet fed when the carriage is within a range D in the Figure at the time of the trailing edge detection of the recording sheet 6, and therefore, the carriage position is not limited when the sheet is fed.

Figures 13, 14:
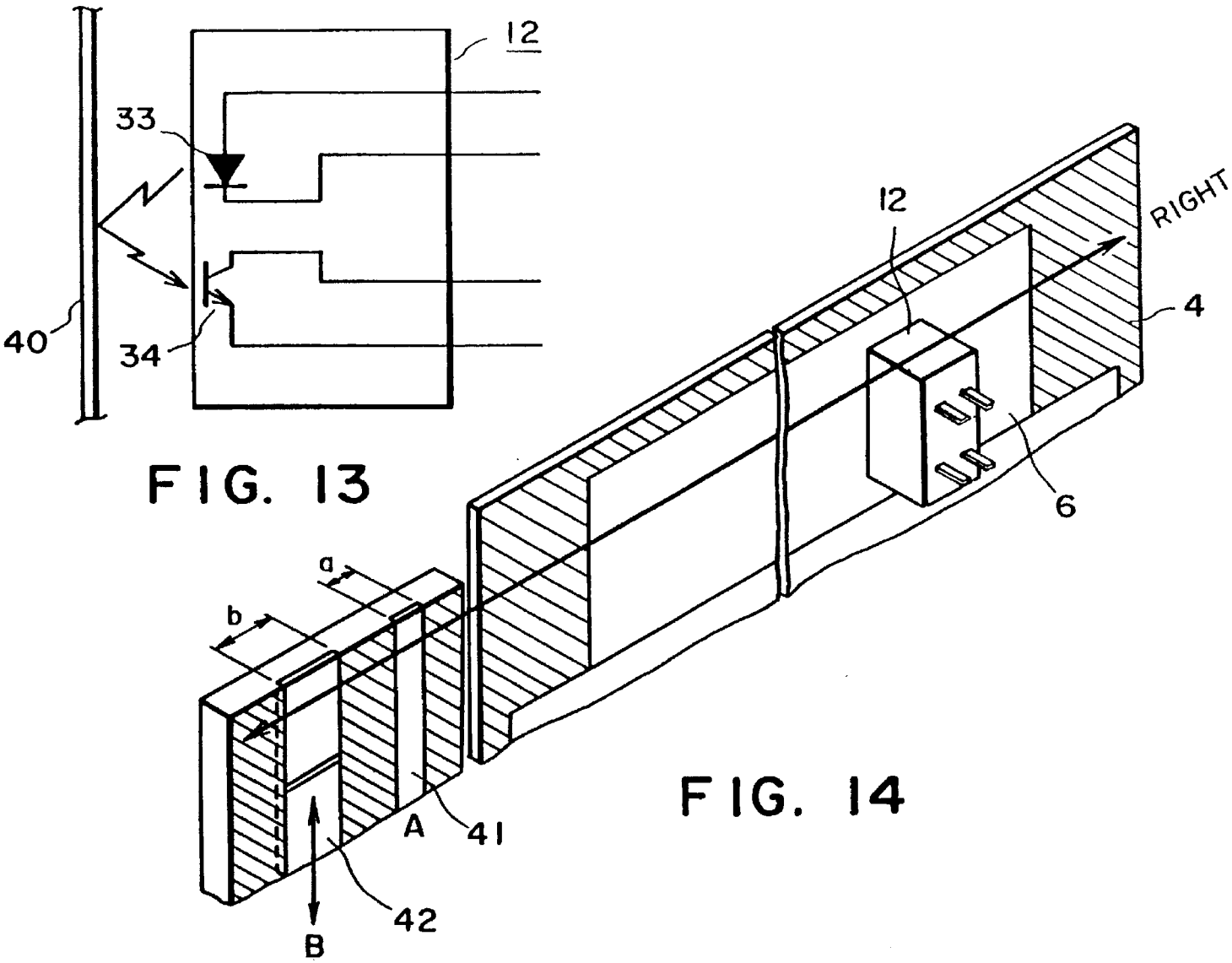
FIG. 13 is a somewhat schematic view illustrating a reflection type sensor according to a fourth embodiment of the present invention.
FIG. 14 is a perspective view illustrating an operation of the sensor shown in FIG. 13.

FIGS. 13–15 show a fourth embodiment of the present invention, wherein a light reflection type sensor is used to detect various states.

FIG. 13 schematically shows the structure of a sheet width detecting sensor 12 of a light reflection type. When the refractive index of the objects 40 to be detected is high, the light emitted from the light emitting element 33 is detected by the light receiving element. When it is low, the light from the light emitting element 33 does not reach the light receiving element, and therefore, no current flows through the light receiving element.

As shown in FIG. 14, along the moving path of the sheet width detecting sensor 12 and within a region adjacent to the left of the recording region in which the recording sheet 6 is fed, there are provided a home position detecting fixed reflecting plate 41 having a width a and an ink cartridge detecting reflecting plate 42 having a width b, and movable upwardly and downwardly in accordance with mounting and dismounting of the ink cartridge, respectively. The surfaces of the home position detecting fixed reflecting plate 41 and the ink cartridge detecting reflecting plate 42 are coated in such that a white level (high reflective index) similarly to the recording sheet 6. On the contrary, the portion hatched in this Figure, that is, the surface of the platen 4, for example, has a surface such that the black level (low refractive index) is provided thereby.

FIG. 15 is a flow chart illustrating the initial processing in the ink jet printer. At step S161, the carriage is first moved to the right, as seen in FIG. 15, through a predetermined distance. Then, at step S162, the carriage is moved to the left, while monitoring by the sheet width detecting sensor 12, to look for the white level position. At step S163, the white level is detected, and then, at steps S164, S165 and S166, the leftward movement is continued until the black level is detected, while counting a distance counter (not shown). By this, the white level width is counted, and at step S167, the discrimination is made as to whether the width is a or not. If the width is not a, the detected white level is not that of the home position detecting fixed reflecting plate 41, and therefore, the operation returns to the step S162, and the leftward movement of the carriage 2 is further continued. If the width is a, the position is stored as a home position A at step S168. Thereafter, the presence or absence of the ink cartridge or the like can be detected by moving the carriage through a known degree with reference to the home position.

According to the structure and control in the first, second, third and fourth embodiments, the wiring for the detection of various conditions of the apparatus is only for the sensor 11 or for the sensor 12 on the carriage. The wiring can be disposed on the head print board of the carriage. Therefore, the results of the sensing can be transmitted to the print board through the head cable in a single route.

Further, a single sensor may be enough for functioning as the home position sensor, the ink cartridge detection sensor, the recovery means home position sensor and the like.

In the foregoing embodiments, the conditions of the recording apparatus to be detected are the presence or absence of the ink cartridge, the presence or absence of the recording sheet and the home position of the recovering means. However, the conditions to be detected may be others. For example, the condition to be detected includes the presence or absence of a font cartridge or, the open or close state of a cover. By increasing the number of detecting flags, the detection may be effected by a single sensor.

In the foregoing embodiments, the detecting means are for the ink jet printer, but the embodiments are applicable to the other types of recording apparatuses as if the recording operation is effected while a carriage is moved.

As will be understood from the foregoing description, according to the embodiments of the present invention, the various conditions of the apparatus can be detected together with the movement of the recording head, and the detection signals may be transmitted through the same wiring path for driving the recording head.

As a result, the servicing and assembling of the apparatus are made easier. In addition, the various conditions can be discriminated using a minimum number of detecting elements, and therefore, the number of the detecting elements can be reduced with the result of significant reduction of the cost.

As shown in FIGS. 1 and 2, the flag is inserted into or retracted from the detection path of the detecting element. The flag is inserted or retracted in association with the ink cassette. The structure suitable for such an ink cassette will be described.

In the case where the ink cassette 27 is mounted into the apparatus, when the attempt is made to retain the ink cassette at a predetermined position with a more or less tolerable margin, the flag 31 may displace to such a position as to obstruct the movement of the carriage, when it is mounted. As shown in FIGS. 1 and 2, the ink cassette is provided with a tapered portion at the two upper corners of which are leading when it is inserted into the apparatus. Two stopper members 84 are provided at positions continuing from the taper.

In a cover for the ink cassette mounting at a side of the upper paper guide 7, there are two projections 86 at upper corners. The projections 86 permit passage of the tapered portion of the ink cassette, but prevent it when they are engaged with the stoppers 84. The position of engagement between the projections and the stoppers 84 is such that the flag 31*c* is outside the movable region of the carriage 2 so that the carriage movement is not obstructed, when the ink cassette 27 acts on the ink cartridge lever portion 28*a*. In addition, the engaging position is so determined that the flag 31*c* is out of contact with the sensor 11, but is assuredly in the clearance formed in the sensor 11.

Therefore, the ink cartridge 27 can assuredly supply the ink, and simultaneously, a member insertable into and retractable from the movement path of a movable detecting element such as a flag 31 is prevented from being inserted beyond a predetermined position.

Figure 18:
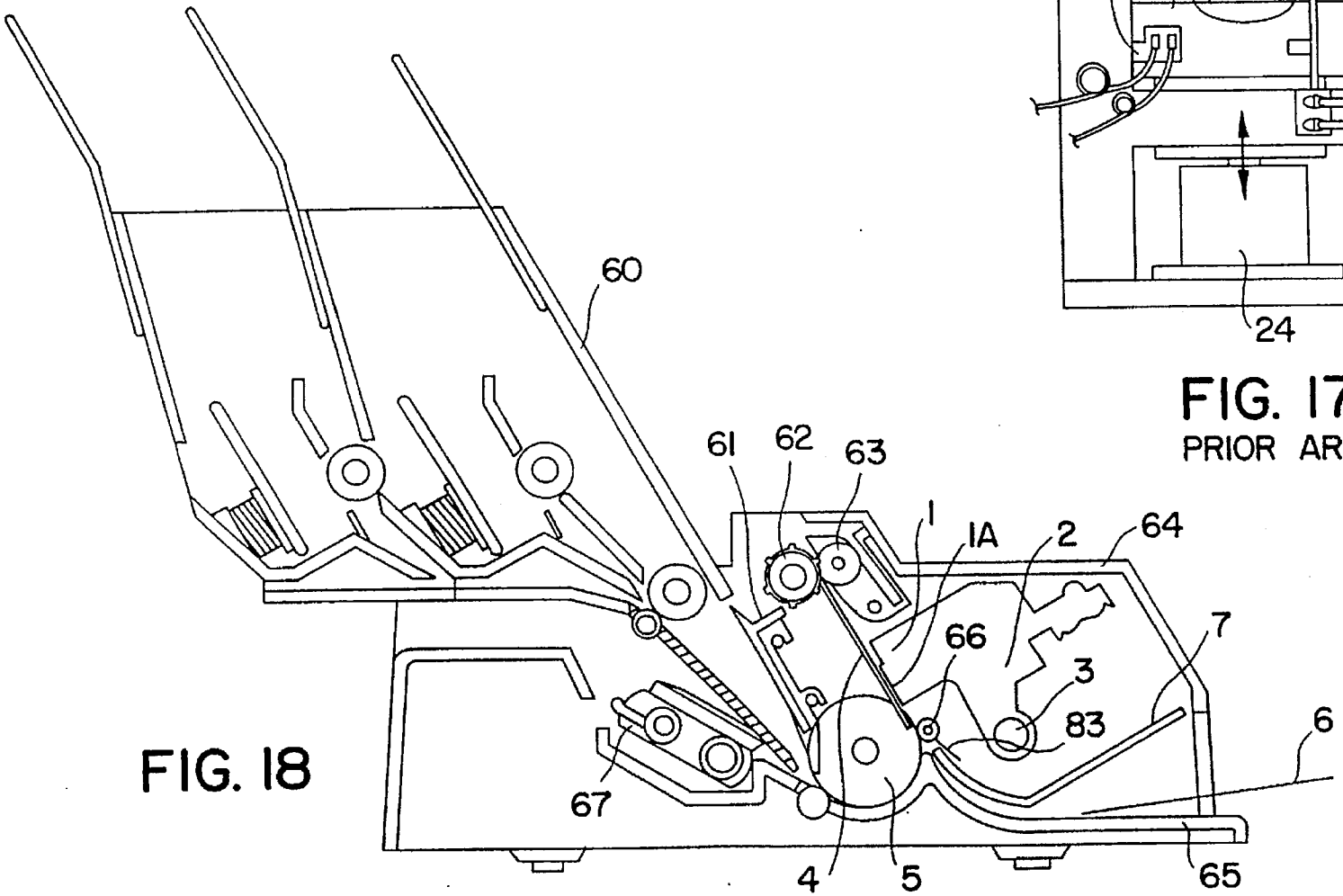
FIG. 18 is a sectional view of a recording apparatus equipped with an automatic sheet feeder (ASF).

Referring to FIGS. 18–23, major parts of the recording apparatus of FIG. 1 will be described. As shown in FIG. 18, the fixed platen 4 functions to retain the recording sheet 6 with a predetermined clearance from the ejection side surface of the recording head 1. The feed roller 5 functions to feed the recording sheet 6. The pinch roller 66 is press-contacted to the feed roller 5 to be driven by the feed roller 5 and to form a nip between the feed roller 5 and the pinch roller 66 to feed the recording sheet 6 through the nip. A pinch roller holder 83 functions to provide the press-contact force to the pinch roller 66. The holder 83 is made of stainless steel plate or the like, and the spring force thereof is effective to urge the pinch roller 66 to the feed roller 5.

The recording sheet 6 supplied by the feed roller 5 and the pinch roller 66 is retained by the fixed platen 4 inclined backwardly at approximately 30 degrees, and therefore, it is easy to watch the print. The recording sheet 6 on which the recording operation has been performed is gripped by a discharging roller 62 and a roller 63 press-contacted thereto, and then is discharged to a stacker 61. FIG. 18 shows the apparatus of FIG. 1 under the condition that an outer cover 64 and an automatic sheet feeding device (ASF60) are provided. The recording sheet may be supplied manually at the front side, and recording sheet may be supplied at the rear by ASF 60. If a pin feed tractor 67 is used, continuous paper is usable. The fixed platen 4 may be provided with a heater at its back side, by which the ink which is not easily dried can still be used.

The description will be made as to the ink supplying system, the recovery system and the sheet feeding system. Those systems are disposed concentratedly at the left side of the recording range of FIG. 1. By doing so, the drive transmission mechanisms are simplified, and the space required thereby is reduced. In addition, the driving source is used for various purposes. The feed motor 21 is the driving source. As will be described hereinafter, the feed motor 21 functions to drive the feed roller 5, the discharge roller 62 and the ASF 60, and in addition, it can operate the recovery system through a series of recovering operation.

The recovery device, as described in conjunction with FIG. 1, comprises a cap 13, a cap carrier for carrying the cap 13, a cap guide shaft 15 for guiding the gap carrier 13A carrying the cap 13, a rail for moving the cap member 13 to the ink ejection side 1A of the recording head, a spring 18 for urging the cap member 13 to the right side initial position and, a pump 24 for suction the ink.

In the recovery operation, after the capping is effected, a vacuum is produced in the cap 13 by driving the pump 24 with which the cap 13 communicates through an unshown tube, so that the ink is sucked through the nozzle of the recording head 1.

Figure 19:
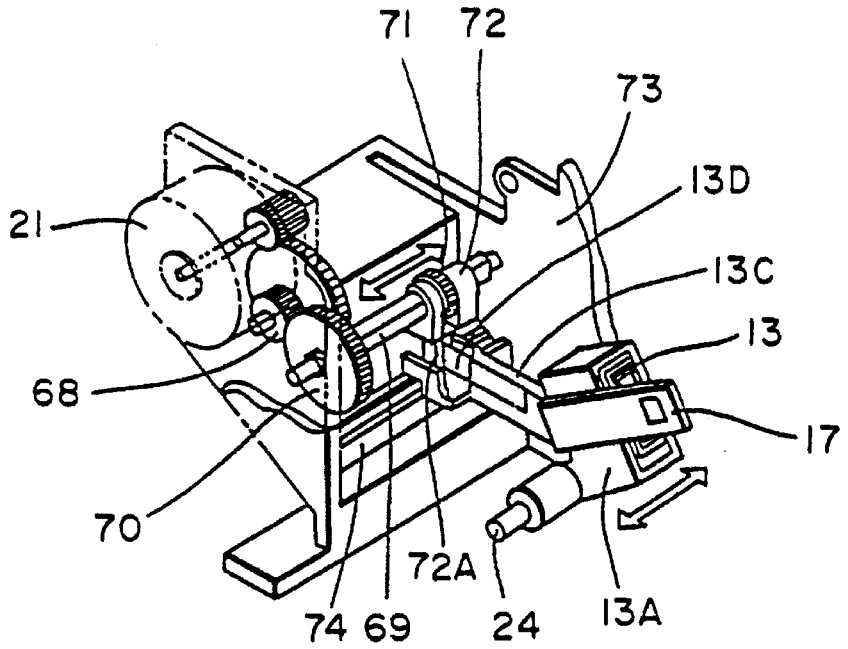
FIGS. 19 and 20 are perspective views illustrating a driving gear switching mechanism, according to another aspect of the present invention.
Figure 20:
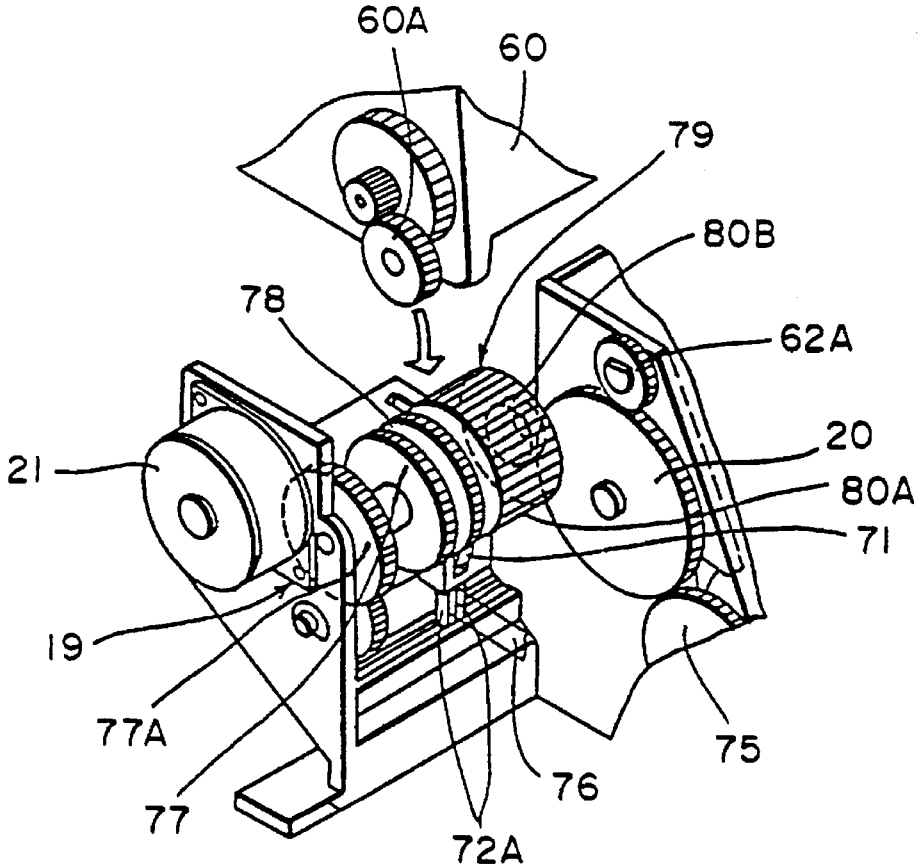

Referring to FIGS. 19 and 20, the switching mechanism for the feed motor 21 will be described.

In FIG. 19, a reference numeral 68 designates an idler gear for transmitting the driving force from the feed motor 21 to a drive gear 70 supported on a slidable gear shaft 69. The slidable gear shaft 69 has a "D" shaped cross-section, and a slidable gear 71 slidable together with the slidable gear shaft 69 is supported on the slidable gear shaft 69 by a sliding holder 72. The sliding holder 72, as shown in FIG. 20, is provided with forked legs 72A extending downwardly. The legs 72A are engaged with a channel-like member 74 supported in parallel with the gear shaft 69 by a frame 73, by which together with the movement of the legs 72*a* along the channel 74, the sliding gear 71 moves together with the sliding holder 72. A second arm 13C is projected from the cap carrier 13A to the channel-like member 74, and a leaf spring 13D is supported on an end of the second arm 13C. The leaf spring 13D is gripped between the forked legs 72A of the sliding holder 72

As will be described hereinafter, when the cap 13 is moved to the left by the engagement with the carriage 2, the sliding holder 72 is moved in the same direction through the leaf spring 13D, the sliding gear 71 is maintained at the position corresponding to the cap 13. The gear train 19 having module meshable with the sliding gear 71 is supported by the frame 73 above the sliding gear 71, as shown in FIG. 20.

Disposed rightmost in the gear train 19, are sheet feeding gears 79 including a large gear 80A and a small gear 80B. The large gear 80A is meshed with the sliding gear 71, and the small gear 88B is meshed with the discharging roller gear 62A through the idler gear 20. The feed roller 5 and the discharging roller 62 may be rotated in the forward and backward direction through the feed gear 75 and the discharging roller gear 62A by the feed motor 21 under the condition that the sliding gear 71 is meshed with the sheet feeding output gear 79.

Referring to FIG. 20, the ASF output gear 78 has the same number of teeth and the same module as the coaxial large gear 80A. It is meshable with the sliding gear 71 depending on the position of the sliding gear 71, and is meshed with the input gear 60A of the ASF 60. Therefore, under the condition that the sliding gear 71 is meshed with the output gear 78 of the ASF 60, the input gear 60A may be rotated in the forward or backward direction. For example, the sheet may be fed by the ASF 60 by its forward rotation, and by the reverse rotation, a more complicated functional operation can be performed such as selection from first and second bins.

Figure 21B:
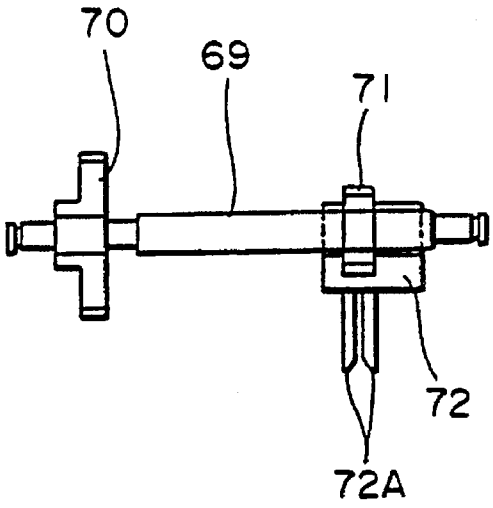
FIG. 21B illustrates in detail a slide gear shaft used in the mechanism of FIG. 21A.
Figure 21A:
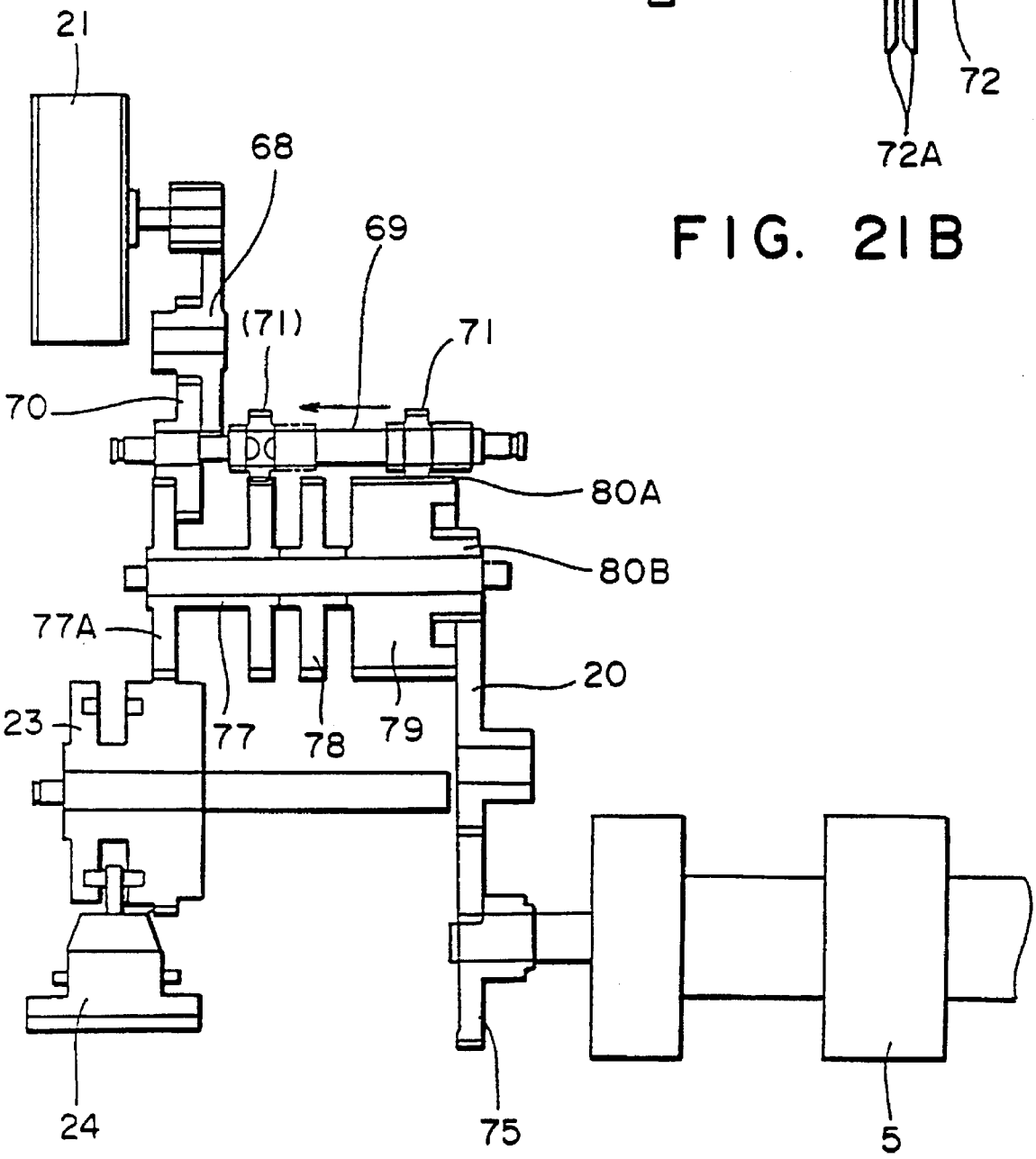
FIG. 21A illustrates a driving gear switching mechanism for the mechanism shown in FIGS. 19 and 20.

A pump output gear 77 disposed at the most left of the gear train 19 in FIG. 20, is meshed with the sliding gear 71 at the most left position, as shown in FIG. 21A (chain lines), and one of the pump output gears 77 is meshed with a driving gear 31A for the pump cam 23. Therefore, when the sliding gear 71 is moved to such a position, the feed motor 21 drives the pump cam 23, and the cam 23 causes the pump 24 to effect the pumping action. As described in the foregoing, depending on the stop position of the carriage 2, the driving force of the feed motor 21 can be transmitted through the sliding gear 71 selectively to a sheet feed output gear 79, an ASF output gear 78 and the pump output gear 77.

Together with the movement of the carriage 2 to the left outside the recording region, the cap carrier 13A is moved, depending on the position of the carriage 2. Together with the movement of the cap carrier 3A, the slide gear 71 is meshed with the above output gears. The operation will be described. In the switching operation of the output gear, the leaf spring 13D connected between the cap carrier 13A and the sliding holder 72 functions as a buffer.

Figure 22A:
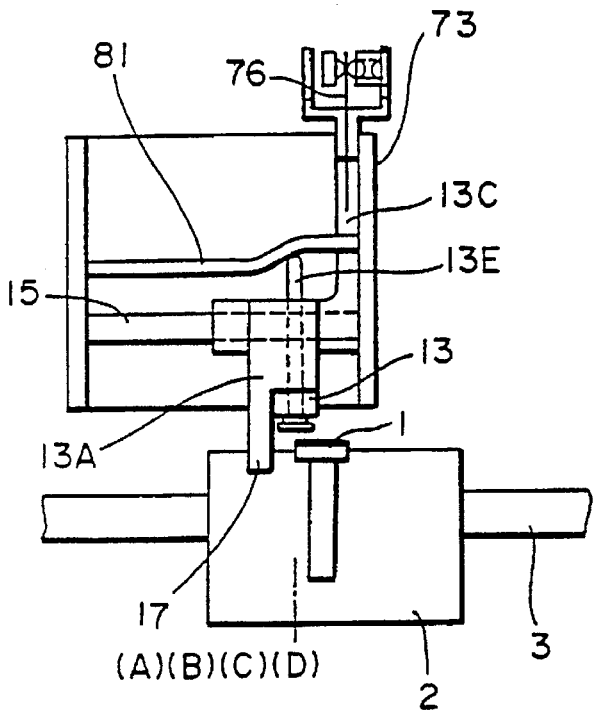
FIGS. 22A, 22B and 22C illustrate engagement between a carriage and a cap carrier, according to an aspect of the present invention.
Figure 22B:
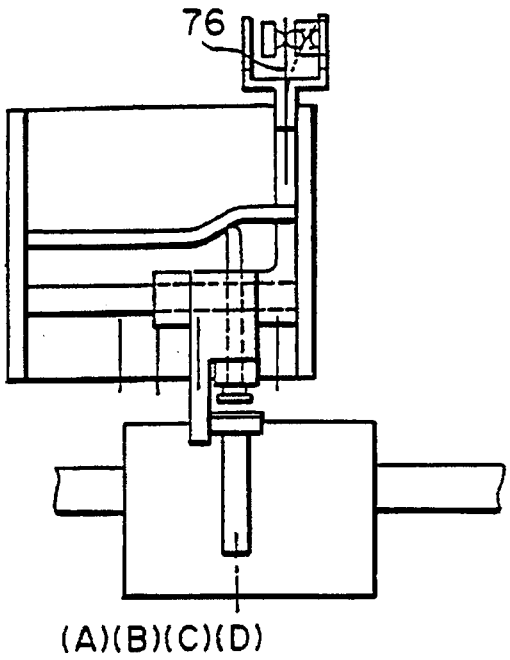
Figure 22C:
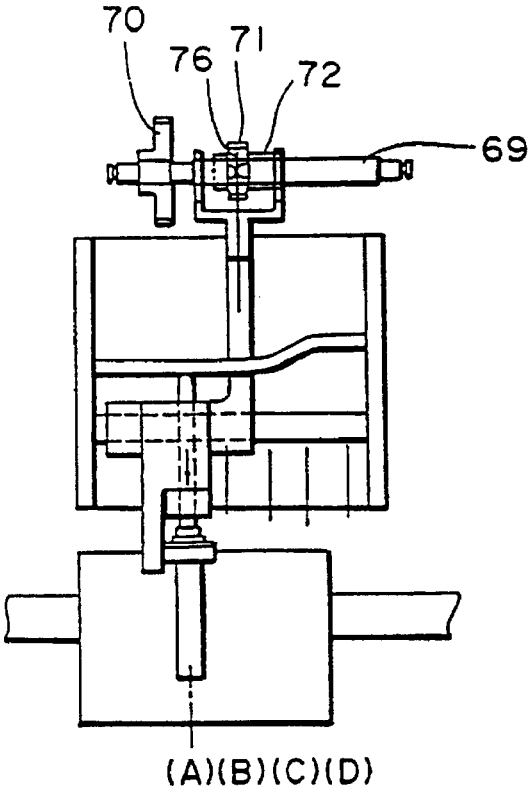

When the carriage 2 moves to the left from the right recording region in FIG. 1 to the position shown in FIG. 22A and further to the position shown in FIG. 22B, the recording-head 1 is engaged with the arm 13B of the cap carrier 13A, and thereafter, the cap carrier 13A is now movable along the guiding shaft 15. In FIGS. 22A–22C, (A)–(D) indicate four positions which can be taken by the cap carrier 13A together with the sliding holder 72 and the sliding gear 71 while carrying the cap 13. In the positions (A)–(C), as shown in FIG. 22C, for example, the cap 13 is pushed toward the recording head 1 by an operating arm 13E of the cap 13 guided along the rail 81. The position D is a waiting position before the sheet feeding during the recording operation. As shown in FIG. 22C, when the carriage 2 is at the position D, the sliding gear 71 is meshed with the sheet feeding output gear 79, although the meshing engagement is not shown in the Figure. With this state, the sheet can be fed by the motor 21.

At the position D, the recording head is faced to the cap, wherein the preliminary ejection not performing the recording operation can be performed in response to the electric signal to the electrothermal transducers of the recording head. In this embodiment, the preliminary ejection is performed at the start of the printing operation and the recording operation is continuously performed for one minute.

When the carriage 2 is moved to the left beyond the position D, the sliding gear 71 becomes out of engagement with the sheet feeding output gear 79 at the position B, and is engaged with the ASF output gear 78. However, in this case, if the teeth are not meshed with each other, the proper meshing engagement with the ASF output gear 78 is not established. However, the cap carrier 13A is forced to the position corresponding to the position (B), upon which the difference in the movement distances due to the mismatch of the teeth is absorbed by the flexible leaf spring 13D. When the feed motor 21 is driven thereafter, the sliding gear 71 is driven through the driving gear 70, by which the proper engagement is established when the teeth are matched, and therefore, the ASF output gear 78 can be driven.

For example, immediately after the sheet is fed while the sliding gear 71 is in meshing engagement with the sheet feeding output gear 79, the teeth of these gears are in firm engagement, and therefore, they are not easily disengaged from each other due to the friction therebetween. Even in this case, the firm engagement state is temporarily maintained by the flexible leaf spring 13D, and then, the feed motor 21 is reversely rotated to remove the frictional strong engagement between the teeth.

The position (A) is a position for performing the recovery operation such as pumping operation or the like. FIG. 22C shows this. With this state, the sliding gear 71 can be meshed with the pump output gear 77. As shown in FIG. 21A, the pump 24 can be driven through the pump cam 23 by one of the gears 77A. The position (C) is a position for waiting with the recording head 1 being capped. The sheet can be fed even under this condition.

Figure 23:
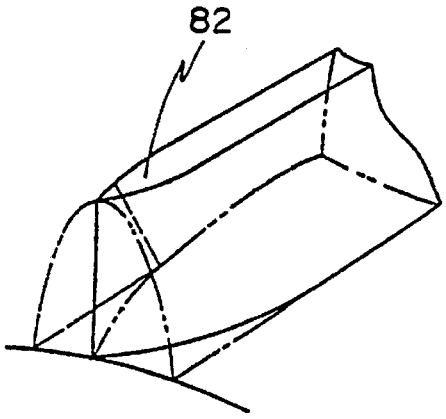
FIG. 23 is a perspective view showing a modified gear tooth in a driving gear switching mechanism, according to an aspect of the present invention.

FIG. 23 shows the gear teeth of the sliding gear 71 and the gears in the gear train 19 meshable with the sliding gear 71. They are rounded at the teeth tips 82 smoothly for the smooth switching engagement with the sliding gear 71.

As described in the foregoing, according to the structure described in conjunction with FIGS. 18–23, there are provided a train of plural gears arranged in parallel along a movement direction of the carriage and driven by a sheet feeding driving source, and a gear member for meshing engagement with a selected one of the plural gears depending on the position of the carriage outside the recording region, wherein the sheet can be fed when the gear member is meshed with one of the gears of the gear train; and an operation other than the sheet feed is possible when the gear member is meshed with another one of the plural gears. Therefore, plural desired operations can be performed selectively using a single driving source. Thus, the cost can be significantly reduced; both of the forward and backward rotation of the driving source can be used; and therefore, the latitude in the operation can be increased.

In addition, the number of operations performed with the single driving force can be easily increased or reduced by increasing or decreasing the number of gears of the gear train. If it is combined with the cap moving mechanism, the capping or the recovery operations can be interrelatedly performed.

Figure 24B:
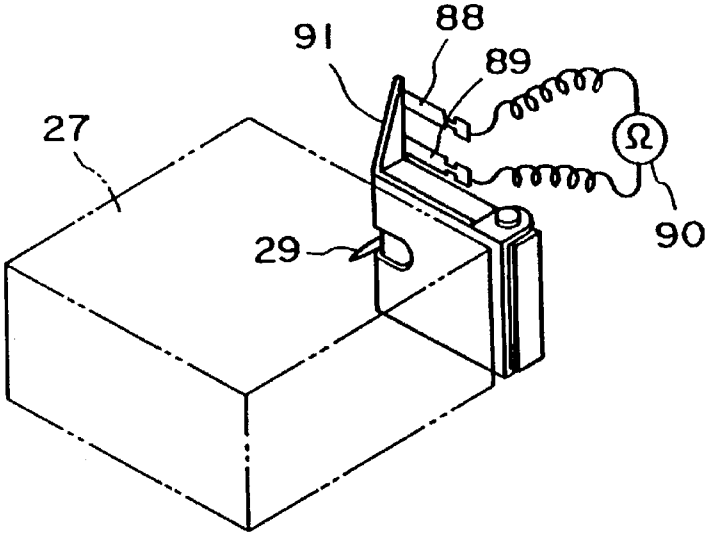
Figure 24A:
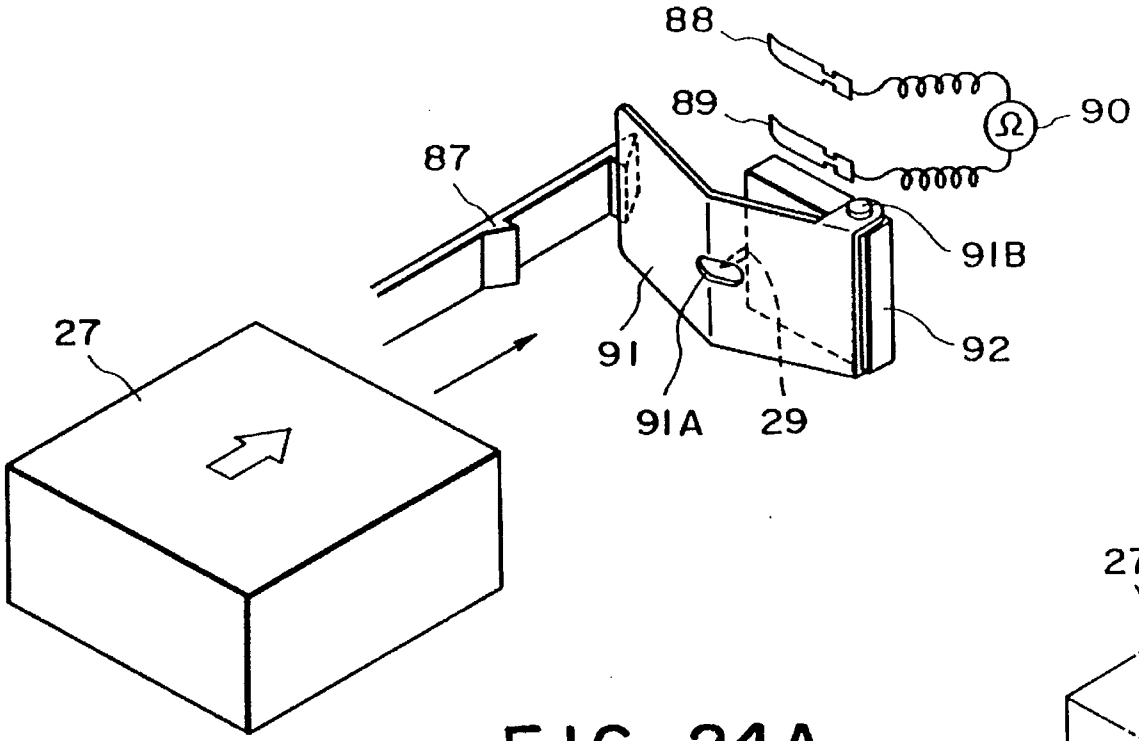
Figure 25B:
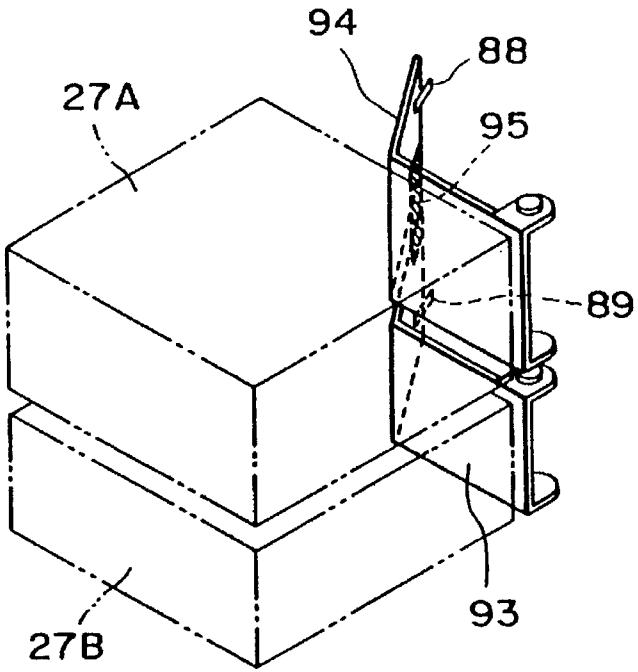
Figure 25A:
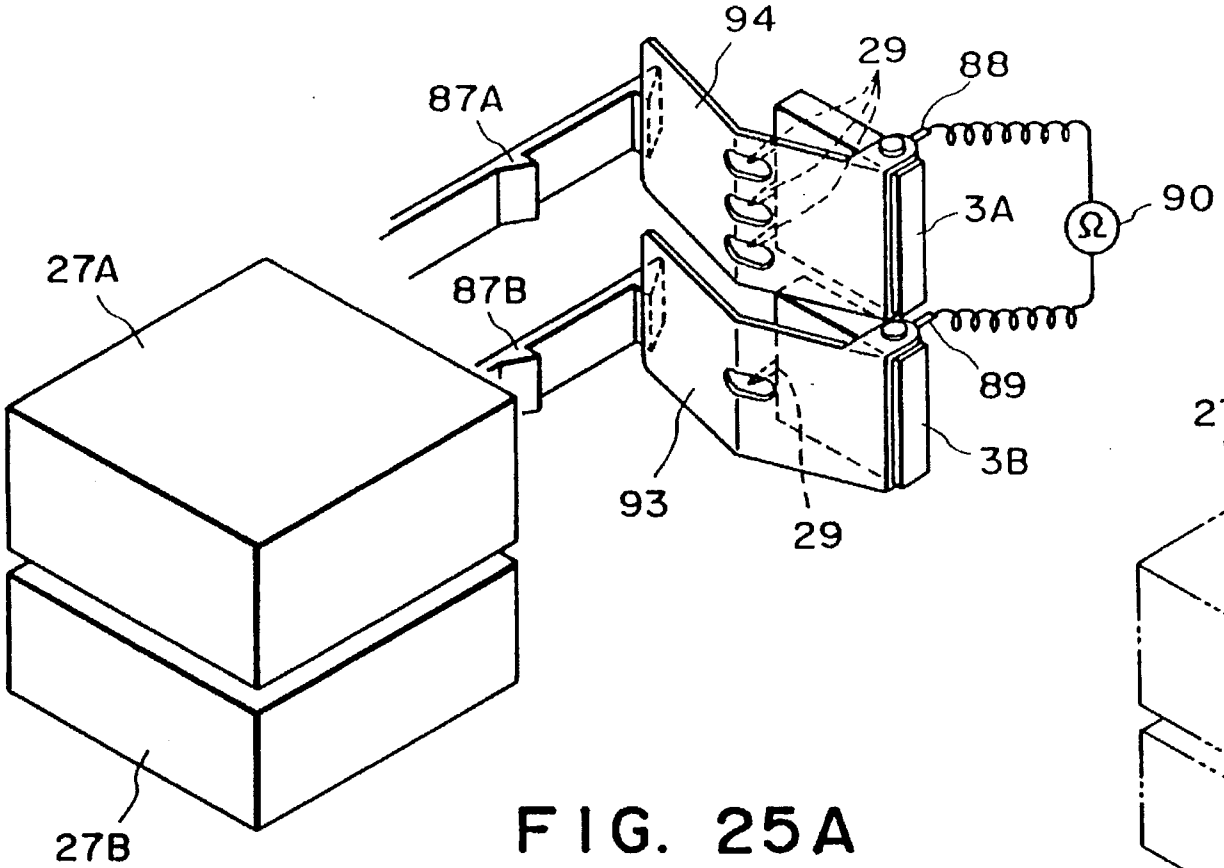

FIGS. 24 and 25 show a compact ink cassette detecting structure. Where e protection member for protection from the needle or needles are provided, the size of the device is increased due to the necessity of the provisions of the presence or absence detecting circuit for the ink cartridge and switching members therefore. FIGS. 24A, 24B, 25A and 25B illustrate the structure for eliminating such inconveniences, and the size of the entire apparatus can be reduced. The structure of this embodiment is replaceable with the ink cassette detecting structure using the flag of FIG. 1. In this embodiment, an openable protection plate made of electrically conductive material is provided around the needles 29 for connecting the ink cartridge with the recording apparatus. The protection plate is openable in association with insertion of the ink cartridge.

Upon completion of the insertion of the ink cartridge, the protection plate completes the circuit in the ink cartridge presence or absence detecting circuit means, by which the presence of the ink cartridge can be detected. The electrically conductive portion may be only at the switching portion or portions.

FIG. 24 best shows the protection member and the needle. The ink cartridge 27 is detachably mountable to be pierced by a needle 29 communicating with the recording head through an ink supply tube, when the ink cartridge is correctly mounted. A needle covering plate 91 is hinged for rotation at its one end and is provided with a window 91A adjacent the tip end of the needle. The hinge of the covering plate 91 is provided with a twisted coil spring to urge the covering plate 91 toward the tip end of the needle.

A pawl is effective to lock the covering plate 91. When there Is no cartridge, the opening and closing of the covering plate 91 is prevented. Two electrodes 88 and 89 constitute a part of a circuit 90 for detecting the presence of the ink cartridge 3 at the rear side.

When the ink cartridge 27 is inserted in the direction indicated by an arrow, the pawl 87 is pushed by a side of the cartridge to release the locking of the needle cover. The needle cover 91 now free to rotate is directly pressed by the cartridge 27 and is rotated backwardly while exposing the tip end of the needle through the window 91A. Sooner or later, the needle 29 is completely connected with the ink cartridge, and an end of the needle cover 91 is brought into contact with the electrodes 88 and 89. The needle cover 91 having the electrically conductive portion now short-circuits the detecting circuit 90 to reduce the electric resistance from infinity to several milli-ohm., the reduction is detected as the presence of the cartridge. The circuit 90 may be such as to detect the resistance change, and another change, and the change of the resistance may be from the large side to the small side, or from the small side to the large side.

When the ink cartridge 27 is retracted, the needle cover 91 is pushed to the front by the coil spring together with the retraction of the cartridge, and then locked by the pawl 87 now reset. With this state, the tip end of the needle can be protected when foreign matter is inserted, and in addition, even if a hand of an operator is erroneously inserted, it can be protected from the damage.

FIGS. 25A and 25B are perspective views of the similar structure but for the case of plural ink cartridges used. The ink cartridge 27A includes three different color ink containers, and an ink cartridge 27B contains one color ink. Correspondingly, the main assembly of the recording apparatus is provided with three needles 29 for the ink cartridge 27A and a needle cover 94 having the corresponding three windows, and one needle 29 for the ink cartridge 27B, and a needle cover 93 having a corresponding single window. The ink cartridges 27A and 27B contact pawls 87A and 87B corresponding to the pawl 87 of FIG. 24A. When plural ink cartridges 27A and 27B are to be inserted, the two electrodes 88 and 89 of the ink cartridge presence or absence detecting circuit are constituted by the needle covers 93 and 94 made of electrically conductive material. A common electrode 95 is effective to contact the needle cover 93 and the needle cover 94 when both of the cartridges 27A and 27B are inserted. In this case, the conductive portion of the plates 93 and 94 may be formed only at the circuit completing portion.

As described in the foregoing, according to this embodiment, the needle protection plate which is opened only when the ink cartridges are inserted is made of electrically conductive material, and therefore, the presence of the cartridge can be detected upon completion of the cartridge insertion, so that the number of parts of the switches or the like can be reduced, and therefore, the cost can be decreased.

By the elimination of the necessity of the switches or the like, the required space can be reduced.

In addition, the problem of erroneous detecting operation due to dissolved air in the ink when the presence or absence of the ink cartridge and/or the ink cartridge due to the change in the resistance through the ink, can be solved by the circuit completed by the mechanical contact.

The present invention is particularly suitably usable in a bubble jet recording head and recording apparatus developed by Canon Kabushiki Kaisha, Japan. This is because, the high density of the picture elements, end the high resolution of the recording are possible.

The typical structure and the operational principle are preferably the principles disclosed in U.S. Pat. Nos. 4,723,129 and 4,740,796. The principle is applicable to a so-called on-demand type recording system and a continuous type recording system. Particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or suction means, preliminary heating means by the ejection electrothermal transducer or by a combination of the ejection electrothermal transducer and additional heating element and means for preliminary ejection not for the recording operation, which can stabilize the recording operation.

As regards the kinds of the recording heads mountable, a single head corresponding to a single color ink, or plural heads corresponding to the plurality of ink materials having different recording color or density may be used. The present invention is effectively applicable to an apparatus having at least one of a monochromatic mode mainly with black and a multi-color mode with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy As positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 7260/985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes-of the improvements or the scope of the following claims.

What is claimed is:

1. An ink jet recording method comprising the steps of:

providing a movable carriage for carrying a recording head and having a sensor;

providing in a carriage moving path a plurality of flags including a flag movable into and away from the carriage moving path in accordance with mounting and demounting of an ink cartridge;

moving the carriage before executing a recording operation, during which the sensor senses a presence or absence of the ink cartridge by sensing which flag is present or absent in the carriage moving path;

outputting an error signal when the ink cartridge is not sensed in said moving step; and effecting the recording operation when the ink cartridge is sensed in said moving step.

2. A method according to claim 1, wherein in said carriage moving step, the carriage is moved by a motor provided with an encoder to determine a rotational position thereof.

3. A method according to claim 2, wherein the carriage is moved in one predetermined direction by rotating the motor through a predetermined count of the encoder, and then the carriage is moved in the other direction until the sensor senses one of the plurality of flags which corresponds to a home position, wherein the home position is stored when the one flag is sensed by the sensor.

4. A method according to claim 3, wherein the motor is further rotated through a predetermined count of the encoder to sense a presence or absence of an ink cartridge detection flag, which is one of the plurality of flags.

5. A method according to claim 4, wherein the motor is further rotated through a predetermined count of the encoder to sense a pump operating position flag, which is one of the plurality of flags, and when the pump operating position flag is sensed, the position is stored as a home position for a recording head recovery operation.

6. An ink jet recording method comprising the steps of:

providing a movable carriage for carrying a recording head and having a sensor;

providing in a carriage moving path a flag movable into and away from the carriage moving path in accordance with mounting and demounting of an ink cartridge;

moving the carriage before executing a recording operation, during which the sensor senses a presence or absence of the ink cartridge by sensing whether the flag is present or absent in the carriage moving path;

outputting an error signal when the ink cartridge is not sensed in said moving step; and effecting the recording operation when the ink cartridge is sensed in said moving step.

* * * * *

UNITED STATES PATENT AND TRADEMARK OFFICE

CERTIFICATE OF CORRECTION

PATENT NO. : 5,627,570

DATED : May 6, 1997

INVENTOR(S) : Hiramatsu et al.

It is certified that error appears in the above-indentified patent and that said Letters Patent is hereby corrected as shown below:

On title page, item

[56] References Cited:

FOREIGN PATENT DOCUMENTS

"33391138 5/1985 Germany" should read "3339138 5/1985 Germany--; and
"1133750 5/1989 Japan" should read --1-133750 5/1989 Japan--.

SHEET 5 OF THE DRAWINGS:

In Fig. 6, "WIPINING" should read --WIPING--.

SHEET 7 OF THE DRAWINGS:

In Fig. 7A, "DETECITION" should read --DETECTION--.

COLUMN 1:

Line 26, "as" should read --as a--.

COLUMN 2:

Line 17, "he" should read --the--;
Line 28, "droplet" should read --droplets--; and
Line 41, "&re" should read --are--.

COLUMN 3:

Line 11, "affecting" should read --effecting--; and

UNITED STATES PATENT AND TRADEMARK OFFICE

CERTIFICATE OF CORRECTION

PATENT NO. : 5,627,570

DATED : May 6, 1997

INVENTOR(S) : Hiramatsu et al.

It is certified that error appears in the above-indentified patent and that said Letters Patent is hereby corrected as shown below:

Line 49, "selectived" should read --a selected--.

COLUMN 4:

Line 27, "control" should read --the control--.

COLUMN 5:

Line 2, "FIG." should read --FIGS.--; and
Line 13, "description" should read --descriptions--.

COLUMN 6:

Line 18, "to-rotate" should read --to rotate--; and
Line 33, "5" should be deleted.

COLUMN 7:

Line 19, "853" should read --S53--; and
Line 49, "7A and 7B" should read --7A, 7B, and 7C--.

COLUMN 8:

Line 5, "is-stored" should read --is stored--; and
Line 54, "are-somewhat" should read --are somewhat--.

UNITED STATES PATENT AND TRADEMARK OFFICE

CERTIFICATE OF CORRECTION

PATENT NO. : 5,627,570

DATED : May 6, 1997

INVENTOR(S) : Hiramatsu et al.

It is certified that error appears in the above-indentified patent and that said Letters Patent is hereby corrected as shown below:

COLUMN 9:

Line 10, "detect-the" should read --detect the--;
Line 20, "Then" should read --Then,--;
Line 34, "this-embodiment" should read --this embodiment--;
Line 53, "clockwisely" should read --clockwise--;
Line 55, "sensor" should read --sensor 11.--; and
Line 59, "fed" should read --is fed--.

COLUMN 10:

Line 16, delete "in";
Line 17, change "sheet 6." to --sheet 6 is provided--; and
Line 58, "close" should read --closed--.

COLUMN 11:

Line 21, "of" should be deleted; and
Line 66, "and" should read --and the--.

COLUMN 12:

Line 14, "operation" should read --operations--;
Line 17, "gap" should read --cap--;
Line 20, "position" should read --position,--; and
Line 21, "suction" should read --sucking--.

UNITED STATES PATENT AND TRADEMARK OFFICE

CERTIFICATE OF CORRECTION

PATENT NO. : 5,627,570

DATED : May 6, 1997

INVENTOR(S) : Hiramatsu et al.

It is certified that error appears in the above-indentified patent and that said Letters Patent is hereby corrected as shown below:

COLUMN 13:

Line 24, "3A" should read --13A--; and
Line 31, "recording-" should read --recording--.

COLUMN 14:

Line 35, "of" should be deleted; and
Line 45, "e" should read --a--.

COLUMN 15:

Line 9, "Is" should read --is--; and
Line 35, "the" should be deleted.

COLUMN 16:

Line 7, "end" should read --and-; and
Line 19, "provide" should read --provided--.

UNITED STATES PATENT AND TRADEMARK OFFICE

CERTIFICATE OF CORRECTION

PATENT NO. : 5,627,570 Page 5 of 5

DATED : May 6, 1997

INVENTOR(S) : Hiramatsu et al.

It is certified that error appears in the above-indentified patent and that said Letters Patent is hereby corrected as shown below:

COLUMN 17:

Line 23, "in usual" should read --in a usual--;
Line 26, "As" should read --is--;
Line 40, "7260/985" should read --71260/1985--; and
Line 51, "purposes-" should read --purposes--.

Signed and Sealed this

Twenty-fourth Day of February, 1998

*Attest:*

Bruce Lehman

BRUCE LEHMAN

*Attesting Officer*

*Commissioner of Patents and Trademarks*